US006873349B2

(12) United States Patent
Uemura

(10) Patent No.: US 6,873,349 B2
(45) Date of Patent: Mar. 29, 2005

(54) IMAGE-RECORDING WITH IMAGE DATA SHIFTING

(75) Inventor: Takayuki Uemura, Kanagawa (JP)

(73) Assignee: Fuji Photo Film Co., LTD, Kanagawa (JP)

( * ) Notice: Subject to any disclaimer, the term of this patent is extended or adjusted under 35 U.S.C. 154(b) by 1 day.

(21) Appl. No.: 10/388,437

(22) Filed: Mar. 17, 2003

(65) Prior Publication Data

US 2003/0179279 A1 Sep. 25, 2003

(30) Foreign Application Priority Data

Mar. 19, 2002 (JP) ..... 2002-076127

(51) Int. Cl.[7] ..... B41J 2/435; B41J 2/47

(52) U.S. Cl. ..... 347/235; 347/250

(58) Field of Search ..... 347/234, 235, 347/248, 249, 250, 38, 229, 262, 264; 382/240, 305

(56) References Cited

U.S. PATENT DOCUMENTS 6,067,383 A * 5/2000 Taniguchi et al. ..... 382/240
6,688,724 B2 * 2/2004 Miyagawa et al. ..... 347/38
2002/0064317 A1 * 5/2002 Hirawa ..... 382/305

FOREIGN PATENT DOCUMENTS

JP 11147326 A * 6/1999 ..... B41J/2/44
JP 3 179 680 4/2001

* cited by examiner

*Primary Examiner*—Hai Pham
(74) *Attorney, Agent, or Firm*—Taiyo, Nakajima & Kato

(57) ABSTRACT

A recording material is angled and wound on a rotating drum. Distortion (inclination) of an image can be eliminated with a comparatively simple control system, and the occurrence of distortion when there is a change in image recording specifications can be prevented. For standard specifications, although image recording lines have helical movement tracks during image-recording, a peripheral end of a printing plate and a peripheral end of an image region can be made to be parallel with one another without distortion of the image region. In contrast, when instructed specifications differ from the standard specifications, a conventional image region becomes distorted because an inclination angle of the printing plate cannot be varied. Accordingly, in a case in which instructed specifications differ from the standard specifications thus, image data is shifted in a sub-scanning direction by soft processing, and the distortion is alleviated.

20 Claims, 16 Drawing Sheets

SERVO MOTOR
200
MOTOR
206
16
12
26
37A
204
208
224
LIGHT SOURCE UNIT
222
DRIVING SYSTEM CONTROL SECTION
205
CONTROLLER
IMAGE PROCESSING SYSTEM CONTROL SECTION
202
IMAGE DATA PROCESSING SECTION
150
IMAGE WRITINGSTRUCTION SECTION JOB DATA
216
IMAGE CLOCK GENERATION SECTION
214
JOB DATA
REFERENCE SIGNAL ACQUISITION SECTION
212
210

IMAGE-RECORDING WITH IMAGE DATA SHIFTING

BACKGROUND OF THE INVENTION

1. Field of the Invention

The present invention relates to an image-recording device which, while moving a recording material and a recording head simultaneously relatively in a main scanning direction and a sub-scanning direction, irradiates a light beam from a recording head on the basis of input image data and records an image on the recording material, and an image-recording method. More particularly the present invention relates to an image-recording device which winds the recording material on a peripheral surface of the rotating body and records an image on the recording material, with a rotation direction of the rotating body serving as the main scanning direction and an axial direction of the rotating body serving as the sub-scanning direction, and an image-recording method.

2. Description of the Related Art

Development of technologies for printing plate exposure devices which employ a sheet-form recording material, particularly a printing plate in which a photosensitive layer is provided on a support, and record an image on the printing plate with a direct laser beam or the like has been advancing. With such technologies, rapid image recording onto printing plates is possible.

In a printing plate automatic exposure device which uses the technology of image-recording onto printing plates, in a state in which a printing plate is wound onto a peripheral surface of a rotating drum, the rotating drum is rotated at high speed (main scanning), a recording head (exposure head) moves along an axial direction of the rotating drum (sub-scanning), and an image is recorded on the printing plate.

Commonly, an edge at a leading end side of winding of the printing plate has been wound on parallel to the axial direction of the rotating drum. Thus, image-writing positions in the sub-scanning direction (the axial direction of the rotating drum) do not shift, and only a little compensation is required even if there are mechanical errors. Therefore, shifting of image-writing positions has not been a problem.

However, when the rotating drum is rotated and main scanning proceeds, main scanning lines are inclined with respect to an edge of the printing plate that is orthogonal to the axis of the rotating drum. Accordingly, inclination of the main scanning lines with respect to the rotating drum has been eliminated by winding the printing plate on at an angle with respect to the rotating drum.

This angle of inclination ($\theta$) is determined by both a number of channels of the light beam that is irradiated and a resolution. For example, if 31 channels and 1200 dpi are taken as general specifications, the inclination angle $\theta$ is determined for such specifications.

However, when specifications are changed, for example, if this resolution is changed to 2400 dpi, the inclination angle becomes $\theta/2$, by a simple calculation. However, because the printing plate is mechanically inclined at the angle $\theta$ and wound on, an inherent inability to achieve a correlation with respect to the specifications arises.

In Japanese Patent No. 3,179,680 (below referred to as "prior technology"), the following is disclosed: a printing plate is not inclined, but image signals are supplied sequentially along inclined pixel rows, which are inclined by precisely a predetermined angle; in accordance therewith, an image-recording beam is scanned while moving continuously in a sub-scanning direction which intersects a main scanning direction; and thus inclination of a recorded image is corrected (abstracted from "effects of the invention" of the prior technology).

To explain this more specifically, as shown in FIGS. 9A to 9F, a buffer memory 400 includes storage regions 400A, 400B and 400C corresponding to, for example, three scanning lines. If a number of lines (in the sub-scanning direction) in each of these regions is a, and the number of pixels in the main scanning direction is b, then storage space corresponding to 3a·b pixels is reserved.

In order to compensate for distortion (inclination) of an image, relative addresses for writing and reading image signals at the buffer memory 400 are controlled. That is, as shown in FIG. 10, reading addresses are inclined relative to writing addresses of the buffer memory 400 in correspondence with an inclination angle $\theta$ of scanning lines L that are created by spiral scanning (refer to the broken lines in FIG. 10) on a recording material P.

In FIGS. 9A, 9B and 9C, a writing region, which is altered for each rotation of the rotating drum, is shown as a region of oblique lines. The writing region is switched between the storage regions 400A, 400B and 400C cyclically. In contrast, a reading region, which is altered for each rotation of the rotating drum, is shown as a region of oblique lines in FIGS. 9D, 9E and 9F. The reading region is cyclically switched so as not to mutually overlap with the writing region.

By repetition of this cycling, image recording can be executed without delays, and image distortion (inclination) can be eliminated.

However, the prior technology described above offers no descriptions or suggestions at all regarding the concept of winding a printing plate on a rotating drum at an angle with respect to the axial direction.

Accordingly, complex control to implement cycling based on all the specifications such that there is no mutual overlap between writing and reading of an image is continuously required. In other words, a simple relationship, in which inputted image data can be used without modification, cannot be used.

SUMMARY OF THE INVENTION

In consideration of the situation described above, an object of the present invention is to provide an image-recording device which can eliminate distortion (inclination) of an image with a comparatively simple control system, by preparatorily inclining and positioning a recording material, and which can reduce shifting of image-recording positions when there is a change in image recording requirements (such as resolution and number of channels). The angle of inclination of the recording material corresponds to an angle which, given a predetermined number of channels of a light beam simultaneously irradiated from a recording head and a predetermined resolution, cancels out an inclination angle between peripheral ends of the recording material and peripheral ends of an image region which is caused by simultaneous progress in a main scanning direction and a sub-scanning direction.

To this end, the present invention provides an image-recording device which irradiates a light beam from a recording head on the basis of input image data while moving a recording material and the recording head simultaneously relatively in a main scanning direction and a sub-scanning direction, and records an image on the recording material, the image-recording device including: a positioning section which, for a predetermined resolution and a predetermined number of channels of the light beam irradiated from the recording head simultaneously, preparatorily inclines and positions the recording material in correspondence with an angle which cancels out an inclination angle between a peripheral end of the recording material and a peripheral end of an image region, the inclination angle being caused by the simultaneous progress in the main scanning direction and the sub-scanning direction; and an image data shift section which, at a time of image recording under conditions in which at least one of a resolution and a number of channels differs from the predetermined resolution and the predetermined number of channels for which the positioning section has carried out positioning, shifts the input image data in the sub-scanning direction on the basis of the difference of the at least one of the resolution and the number of channels.

The recording material is preparatorily inclined by the positioning section in accordance with the angle that cancels out the inclination angle between peripheral ends of the recording material and peripheral ends of the image region, which is caused by the simultaneous progress in the main scanning direction and the sub-scanning direction for the predetermined number of channels of the light beam that are simultaneously irradiated from the recording head and the predetermined resolution. For example, if a 31-channel light beam and a resolution of 1200 dpi are taken as general specifications, and the main scanning and sub-scanning speeds are constant, a unique angle θ at which the recording material should be inclined can be found by calculation and the recording material is basically always positioned at this inclination angle.

As a result, peripheral ends of the recording material and peripheral ends of the image region can be aligned (edges facing in the same direction can be made parallel) without further rearrangement at writing and reading of any ordinary image data.

Herein, when an image is to be recorded at specifications that differ from the aforementioned general specifications, image-recording is carried out at an inclination angle of the specified recording material which differs from the inclination angle θ.

Therefore, at a time of image-recording under conditions with a different resolution and/or number of channels, when positioning by the positioning section has been carried out, the inputted image data is shifted in the sub-scanning direction at the image data shift section on the basis of the difference in the resolution and/or number of channels. Consequently, even when specifications (such as resolution and number of channels) change, relative positional relationships between the recording material and the recording image can be maintained.

In an embodiment of the present invention, the image data shift section includes a storage section which stores the input image data in accordance with addresses which are designated on the basis of a difference from at least one of the predetermined resolution and the predetermined number of channels, and wherein, at the time of image-recording, the input image data is read on the basis of the addresses stored at the storage section.

At the time of storage at the storage section, the inputted image data is preparatorily stored at addresses which are designated on the basis of the difference from the specified resolution and number of channels. Thus, at the time of reading, reading in a usual state is satisfactory.

In an embodiment of the present invention, in a case in which the resolution and number of channels at the time of image recording differ from the resolution and number of channels used as a standard at the time of storing at the storage section, and an angular difference occurs therebetween, addresses are altered in correspondence with the angular difference after the image data stored at the storage section has been read.

Reading can be made to correspond to a different inclination angle by altering addresses during reading of the image data stored at the storage section.

In an embodiment of the present invention, the image recording device further comprises a main scanning image-writing timing control section which, on the basis of the inclination angle of the recording material, specifies a time difference for a timing of commencement of image-writing the main scanning direction.

Timing of commencement of image-writing the main scanning direction are shifted relative to regular positions because the recording material is inclined. Therefore, the main scanning writing timing control section specifies a time difference based on the inclination angle of the recording material. Consequently, distortion such that an image region has a so-called parallelogram shape does not occur.

In an embodiment of the present invention, the storage section employs a burst transfer-capable storage device.

A burst transfer-capable storage device, such as an SDRAM (synchronous dynamic random access memory) or the like can be applied as the storage device. In an SDRAM, at a time of burst transfer, a high-speed transfer contemporaneous with rising of a clock signal is possible. As an alternative to SDRAM, a DDR SDRAM (double data rate SDRAM), utilizes both rises and falls of a clock signal. Accordingly, with the same clock, data transfer can be executed twice as often as with SDRAM.

When a burst transfer-capable storage device is applied, a burst length thereof (a number of pixels in one transfer) is a unit for the addresses that are preparatorily designated and stored for the inputted image data on the basis of the difference from the specified resolution and number of channels.

In another embodiment, the present invention provides an image-recording device including: a movement section which moves a recording material in a main scanning direction; a recording apparatus which, while moving in a sub-scanning direction which intersects the main scanning direction, records an image at the recording material on the basis of supplied image data; and an image processing section which supplies image data to the recording apparatus. In this image-recording device, the recording material is attached to the movement section such that a standard direction specified for the recording material includes a predetermined angle with respect to the main scanning direction, and in a case in which a direction of image recording of the recording apparatus on the recording material at a time of simultaneous movement of the movement section and the recording apparatus is displaced from the standard direction, the image processing section supplies the image data to the recording apparatus having altered a predetermined recording sequence of a plurality of pixel data which form the image data to be supplied to the recording apparatus, so as to reduce shifting of image recording positions on the recording material, which shifting is caused by a difference between the image recording direction and the standard direction.

In an embodiment, the standard direction of the recording material is the same as the direction of image recording by the recording apparatus under predetermined recording conditions, and the image recording direction changes depending upon image recording conditions.

In an embodiment, the recording apparatus includes a recording head and the recording conditions include a resolution and a number of channels of a light beam that are simultaneously irradiated from the recording head.

In an embodiment, the image processing section includes: an image data storage section which stores image data; an address conversion section which, so as to reduce the shifting of image recording positions on the recording material due to the difference between the image recording direction and the standard direction, converts addresses of writing to the image data storage section on the basis of the difference; and a writing section which writes the image data to the image data storage section on the basis of the writing addresses that have been converted by the address conversion section.

In an embodiment, the address conversion section finds a predetermined number of pixels in the main scanning direction based on the difference between the image recording direction and the standard direction, and calculates the addresses of writing to the image data storage section such that the image data is stored at the image data storage section having been shifted by an amount corresponding to one pixel in the sub-scanning direction for each incidence in the main scanning direction of the predetermined number of pixels.

In an embodiment, the address conversion section finds a pixel shift amount in the sub-scanning direction for one cycle of main scanning according to:

$$\text{sub-scanning direction pixel shift amount} = (\tan \theta 2 - \tan \theta 1) \times \text{size in main scanning direction/sub-scanning pitch}$$

$\theta 1$ being the image recording direction relative to the main scanning direction and $\theta 2$ being the standard direction relative to the main scanning direction, and finds a predetermined number of pixels in the main scanning direction until a one-pixel shift in the sub-scanning direction according to:

$$\text{main scanning direction predetermined pixel number} = \text{total number of pixels in the main scanning direction/the sub-scanning direction pixel shift amount.}$$

In an embodiment, the angles $\theta$ of the image recording direction relative to the main scanning direction and of the standard direction relative to the main scanning direction are each found according to:

$$\tan \theta = (\text{number of channels}) \times (\text{sub-scanning pitch})/(\text{main scanning direction size})$$

the number of channels being a number of light sources, and the sub-scanning pitch being determined by a resolution.

In an embodiment, the image data storage section includes a burst transfer-capable storage device.

In an embodiment, the address conversion section finds a predetermined number of pixels in the main scanning direction until a one-pixel shift in the sub-scanning direction from the difference between the image recording direction and the standard direction, and converts the writing addresses such that the image data is written to the image data storage section having been shifted one pixel in the sub-scanning direction for each incidence in the main scanning direction of a number of pixels which is an integer multiple of a burst length of the burst transfer-capable recording device and which is closest to the predetermined number of pixels in the main scanning direction.

In an embodiment, the address conversion section carries out address conversion employing an address conversion table prepared in advance.

In an embodiment, the image processing section includes: an image data storage section which stores image data; an address conversion section which, so as to reduce the shifting of image recording positions on the recording material due to the difference between the image recording direction and the standard direction, converts addresses for writing to the image data storage section and converts addresses for reading from the image data storage section on the basis of the difference; a writing section which writes the image data to the image data storage section on the basis of the writing addresses that have been converted by the address conversion section; and a reading section which reads the image data from the image data storage section on the basis of the reading addresses.

In an embodiment, the image data storage section includes a burst transfer-capable storage device, and the address conversion section carries out address conversion employing an address conversion table prepared in advance.

In an embodiment, the image processing section includes: an image data storage section which stores image data; an address conversion section which, so as to reduce the shifting of image recording positions on the recording material due to the difference between the image recording direction and the standard direction, converts addresses for reading from the image data storage section on the basis of the difference; and a reading section which reads the image data from the image data storage section on the basis of the reading addresses that have been converted by the address conversion section.

In an embodiment, the image data storage section includes a burst transfer-capable storage device, and the address conversion section carries out address conversion employing an address conversion table prepared in advance.

Still further, it is advantage of the present invention to provide the image-recording method including steps of: at an image-recording device which includes a movement section which moves a recording material in a main scanning direction and a recording apparatus which, while moving in a sub-scanning direction which intersects the main scanning direction, records an image at the recording material on the basis of supplied image data, disposing at least one of the recording material and the recording apparatus such that a standard direction, which is specified for the recording material, and the main scanning direction are at a predetermined angle; and in a case in which a direction of image recording of the recording apparatus on the recording material is displaced from the standard direction at a time of simultaneous movement of the movement section and the recording apparatus, supplying the image data to the recording apparatus having altered a predetermined recording sequence of a plurality of pixel data which form the image data to be supplied to the recording apparatus, so as to reduce shifting of image recording positions on the recording material, which shifting is caused by the difference between the image recording direction and the standard direction.

DESCRIPTION OF THE EMBODIMENTS

Now, a first embodiment relating to the present invention will be described with reference to the drawings.

Herebelow, general structure of a printing plate automatic exposure device 150, which is employed as an image-recording device, is illustrated.

Figure 1:
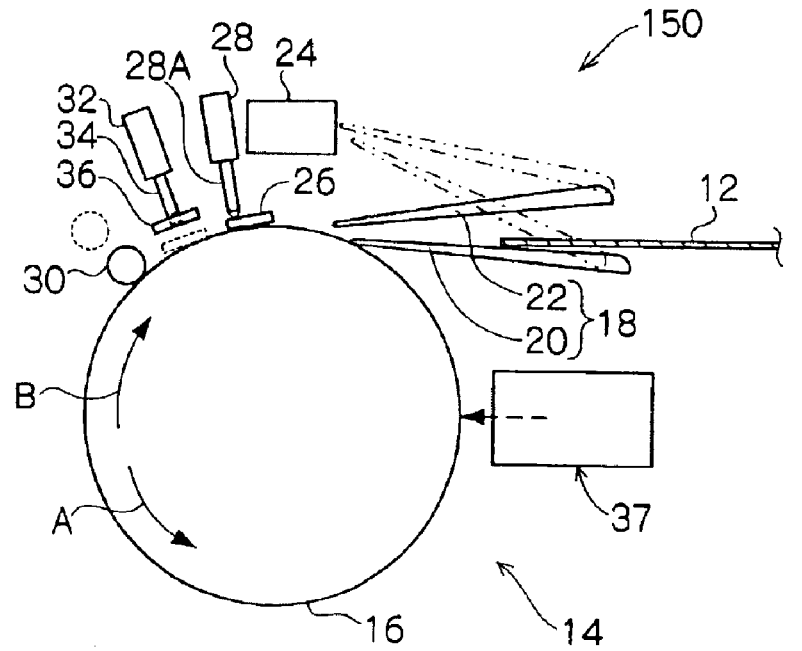
FIG. 1 is a schematic view of a printing plate automatic exposure device relating to a first embodiment.

As shown in FIG. 1, an exposure section 14 of the printing plate automatic exposure device 150 is structured with a rotating drum 16, which retains a printing plate 12 wound onto a peripheral surface thereof, as a principal component. The printing plate 12 is guided by a conveyance guide unit 18 and fed in from a tangential direction of the rotating drum 16.

A puncher 24 is disposed upward of the rotating drum 16 in FIG. 1.

The conveyance guide unit 18 is structured with a supply guide 20 and an ejection guide 22.

A positional relationship of the supply guide 20 and ejection guide 22 of the conveyance guide unit 18 relative to one another is set to a horizontal V shape, and the supply guide 20 and ejection guide 22 are structured to rotate through a predetermined angle about a center of rotation which is at the right end side of FIG. 1. Consequent to this rotation, the supply guide 20 and ejection guide 22 can be made to selectively correspond with the rotating drum 16 or the puncher 24.

The printing plate 12 is first guided by the supply guide 20 and fed into the puncher 24, and a cut-out for positioning is formed at a leading end of the printing plate 12.

After processing by the puncher 24, the printing plate 12 is temporarily returned to the supply guide 20, and then moved to a position corresponding with the rotating drum 16.

The rotating drum 16 is rotated by unillustrated driving means in a direction for loading and exposing the printing plate 12 (the direction of arrow A in FIG. 1) and a direction of removing the printing plate 12 (the direction of arrow B in FIG. 1), which is a direction opposite to the loading/exposing direction.

As shown in FIG. 1, a leading end chuck 26 is attached to the rotating drum 16 provided at the exposure section 14, at a predetermined position of the outer peripheral surface. When the printing plate 12 is to be loaded at the rotating drum 16, first, the rotating drum 16 is stopped with the leading end chuck 26 at a position facing a leading end of the printing plate 12 which is being fed in by the supply guide 20 of the conveyance guide unit 18 (a printing plate loading position).

In the exposure section 14, a mounting unit 28 is provided facing the leading end chuck 26 at the printing plate loading position. When one end side of the leading end chuck 26 is pushed by extension of an extending/contracting rod 28A of the mounting unit 28, insertion of the printing plate 12 between the leading end chuck 26 and the peripheral surface of the rotating drum 16 becomes possible.

In a state in which the leading end of the printing plate 12 has been inserted between the leading end chuck 26 and the rotating drum 16, the extending/contracting rod 28A of the mounting unit 28 is drawn back and pressure on the leading end chuck 26 is released. Consequently, the printing plate 12 is sandwiched between the leading end chuck 26 and the peripheral surface of the rotating drum 16, and retained.

At this time, the leading end of the printing plate 12 is abutted against positioning pins (not shown), which are provided at the rotating drum 16. Thus, the printing plate 12 is positioned.

When the leading end of the printing plate 12 has been fixed at the rotating drum 16, the rotating drum 16 rotates in the loading/exposing direction A. Consequently, the printing plate 12 being fed from the supply guide 20 of the conveyance guide unit 18 is wound onto the peripheral surface of the rotating drum 16.

A squeeze roller 30 is disposed in a vicinity of the peripheral surface of the rotating drum 16, at a downstream side in the loading/exposing direction from the printing plate loading position. The squeeze roller 30 pushes toward the printing plate 12 being wound on the rotating drum 16 by moving toward the rotating drum 16, and closely contacts the printing plate 12 with the peripheral surface of the rotating drum 16.

A trailing end chuck attaching/removing unit 32 is disposed in a vicinity upstream from the squeeze roller 30 with respect to the loading/exposing direction of the rotating drum 16. At the trailing end chuck attaching/removing unit 32, a trailing end chuck 36 is mounted at a distal end of a shaft 34, which protrudes towards the rotating drum 16.

When a trailing end of the printing plate 12 wound onto the rotating drum 16 opposes the trailing end chuck attaching/removing unit 32, the shaft 34 is projected and the trailing end chuck 36 is mounted at a predetermined position of the rotating drum 16. Consequently, the trailing end chuck 36 sandwiches and retains the trailing end of the printing plate 12 between the trailing end chuck 36 and the rotating drum 16.

When the leading end and trailing end of the printing plate 12 are retained at the rotating drum 16, the squeeze roller 30 is moved away. Thereafter, the rotating drum 16 is rapidly rotated at a predetermined rotation speed (main scanning) and, synchronously with this rotation of the rotating drum 16, a light beam modulated on the basis of image data is irradiated from a recording head section 37.

Figure 2:
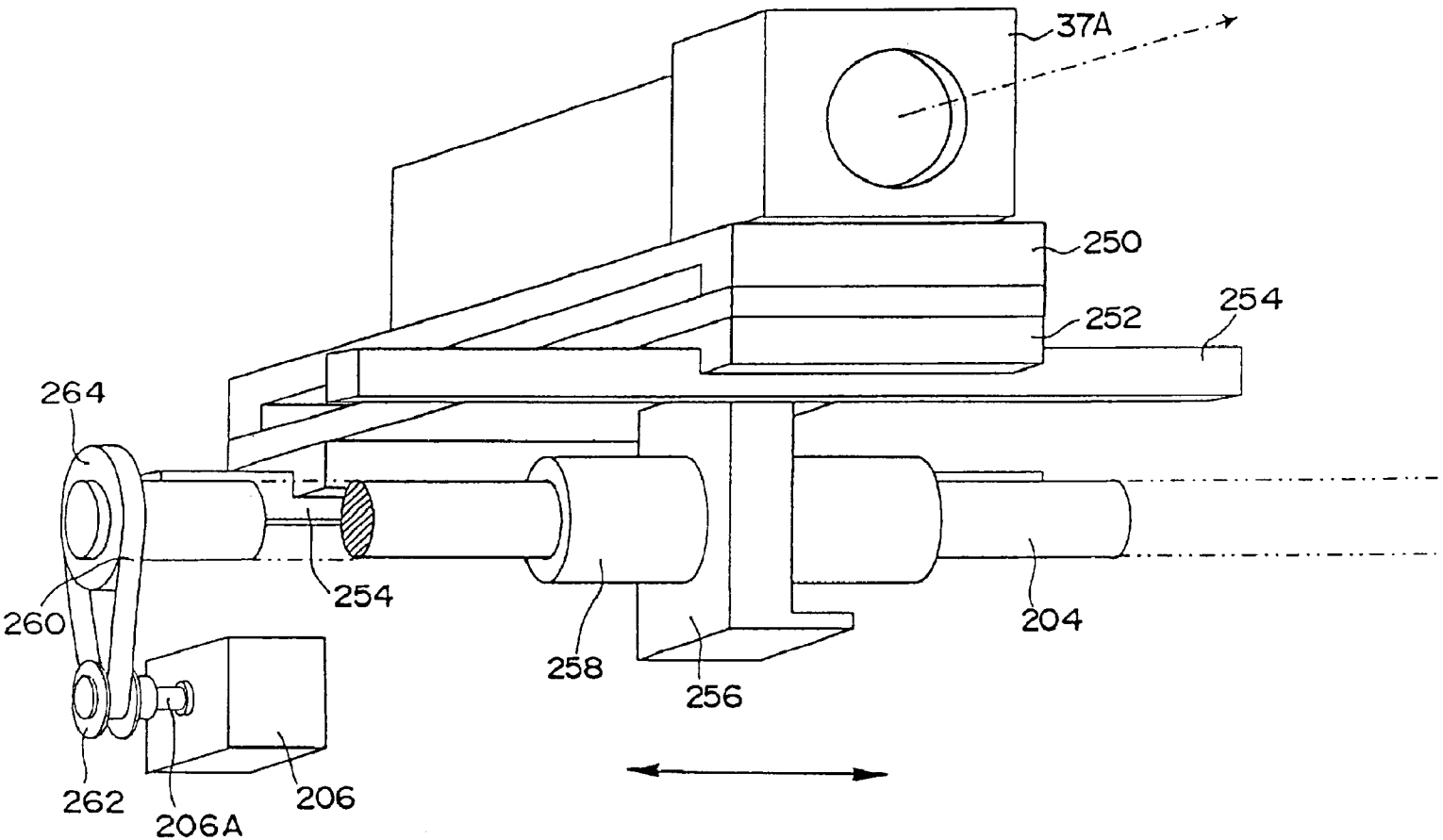
FIG. 2 is a perspective view showing schematic structure of a recording head.

FIG. 2 shows general structure of the recording head section 37. A recording head main body 37A of the recording head section 37 is supported at a base portion 250. The base portion 250 is mounted on a sliding base 252, which is a sliding body which structures a ball-screw mechanism. Consequently, the recording head main body 37A moves with the sliding base 252.

The sliding base 252 is guided in the axial direction of the rotating drum 16 (see FIG. 1), along two mutually parallel rails 254. A connecting portion 256 for connecting the sliding base 252 with a shaft 204 of the ball-screw mechanism is attached at a lower portion of the sliding base 252.

A tube portion 258 is formed at the connecting portion 256. A female thread, which screwingly engages with a male thread formed at the shaft 204, is formed at the tube portion 258.

At one end portion of the shaft 204, a sprocket 264 is coaxially attached and a belt 260 is wound therearound. The belt 260 is also wound round a sprocket 262, which is attached to a rotating shaft 206A of a pulse motor 206. Consequently, driving force of the pulse motor 206 (rotation of the rotating shaft 206A) can be transmitted to the shaft 204 via the belt 260, and a rotation speed of the shaft 204 can be controlled by a rotation speed of the pulse motor 206.

Figure 3:
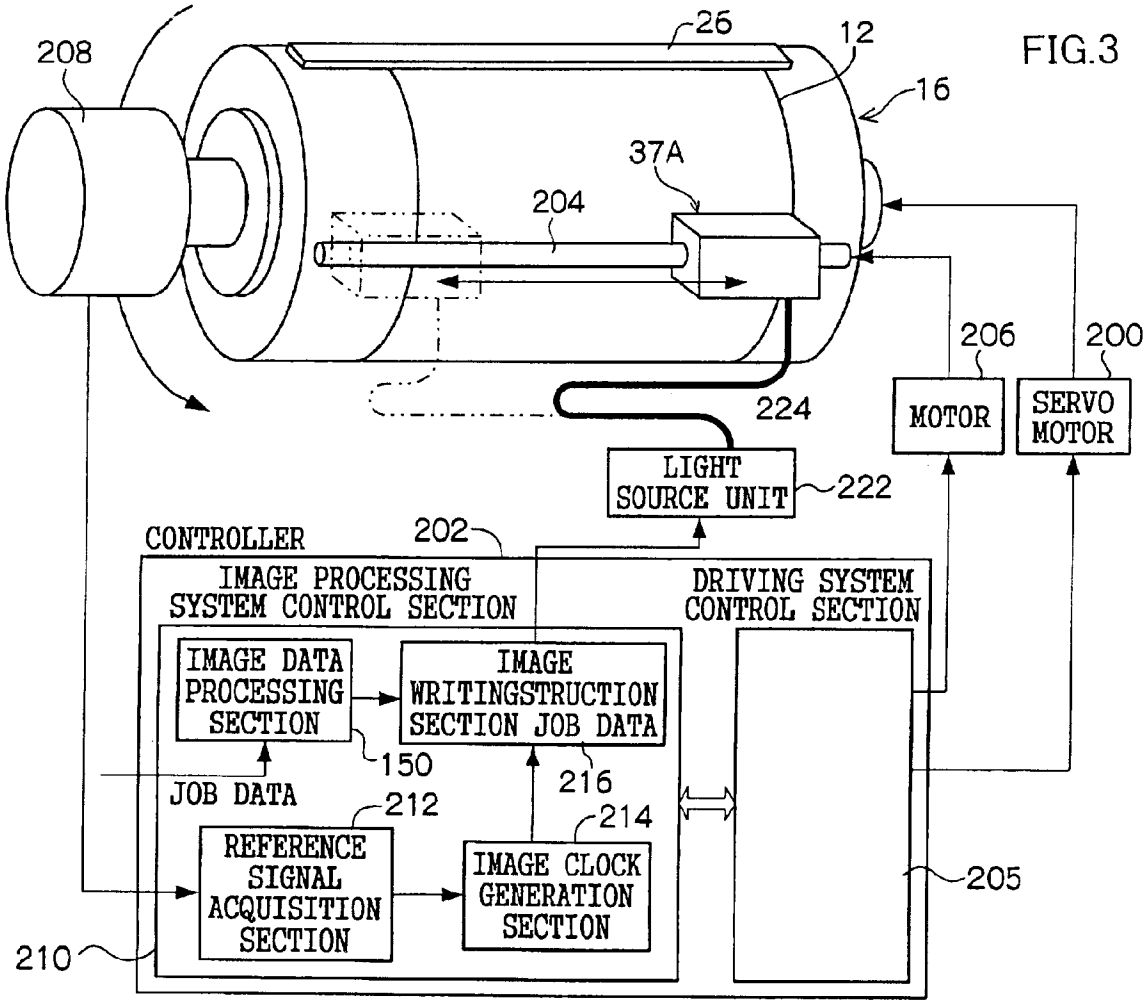
FIG. 3 is a block diagram showing schematic structure of a controller for moving a rotating drum and the recording head.

As shown in FIG. 3, the recording head main body 37A is positioned at a home position, which is a position separated from the peripheral surface at one axial direction end of the rotating drum 16. The recording head main body 37A is moved in the axial direction of the rotating drum 16 by driving force of the pulse motor 206. Thus, the recording head main body 37A moves for sub-scanning.

Consequently, the recording head main body 37A moves along the shaft 204 (sub-scanning) in accordance with rotation of the rotating drum 16 (main scanning). Hence, an image is scanned and exposed at the printing plate 12 on the basis of image data.

When scanning and exposure of the printing plate 12 has finished, the rotating drum 16 is temporarily stopped at a position at which the trailing end chuck 36 retaining the trailing end of the printing plate 12 faces the trailing end chuck attaching/removing unit 32, and the trailing end chuck 36 is removed from the rotating drum 16. Consequently, the trailing end of the printing plate 12 is released.

Next, the rotating drum 16 is rotated in the direction B for removal of the printing plate 12. Thus, the printing plate 12 is discharged, from a trailing end side thereof, along a tangential direction of the rotating drum 16 to the ejection guide 22 of the conveyance guide unit 18. Thereafter, the printing plate 12 is ejected to a developing device for subsequent processes.

FIG. 3 shows a control system for rotation of the rotating drum 16, movement of the recording head section 37, and image recording by the recording head section 37 on the basis of image signals.

The rotating drum 16 is rotated by driving force of a servo motor 200. A rotation speed of the servo motor 200 is controlled on the basis of driving signals from a driving system control section 205 of a controller 202.

As shown in FIG. 2, the shaft 204, at which the male thread of the ball-screw mechanism is formed, is axially rotated by the pulse motor 206, and thus the recording head section 37 is moved in the axial direction of the rotating drum 16. A driving speed of the pulse motor 206 is controlled on the basis of driving signals from the driving system control section 205 of the controller 202.

A rotary encoder 208 is coaxially attached at a shaft portion at an axial direction one end portion of the rotating drum 16.

Pulse signals from the rotary encoder 208, which correspond with the rotation speed of the rotating drum 16, are transmitted to a reference signal acquisition section 212, which structures part of an image processing system control section 210 at the controller 202.

The reference signal acquisition section 212 is connected to an image clock generation section 214. The image clock generation section 214 generates the image clock on the basis of rotation of the rotating drum 16, considering a main scanning commencement timing or the like, for each occurrence of a predetermined rotation (for example, one full turn). The image clock is transmitted to an image writing-struction section 216.

Image data corresponding to a number of lines that are required for main scanning at the same time is inputted to the image writingstruction section 216 from an image data processing section 150 which is described in detail later, and this image data is transmitted to a light source unit 222 with a predetermined timing.

A plurality of light sources (laser diodes or the like) are provided at the light source unit 222. The light from each light source is guided to the recording head section 37 through an optical fiber 224.

The image writingstruction section 216 controls the recording head section 37 such that a light beam, which is modulated on the basis of the inputted image signals, is irradiated onto the printing plate 12. An image is recorded on the printing plate 12 with rotation of the rotating drum 16 (main scanning), and movement of the recording head section 37 (sub-scanning).

Figure 4:
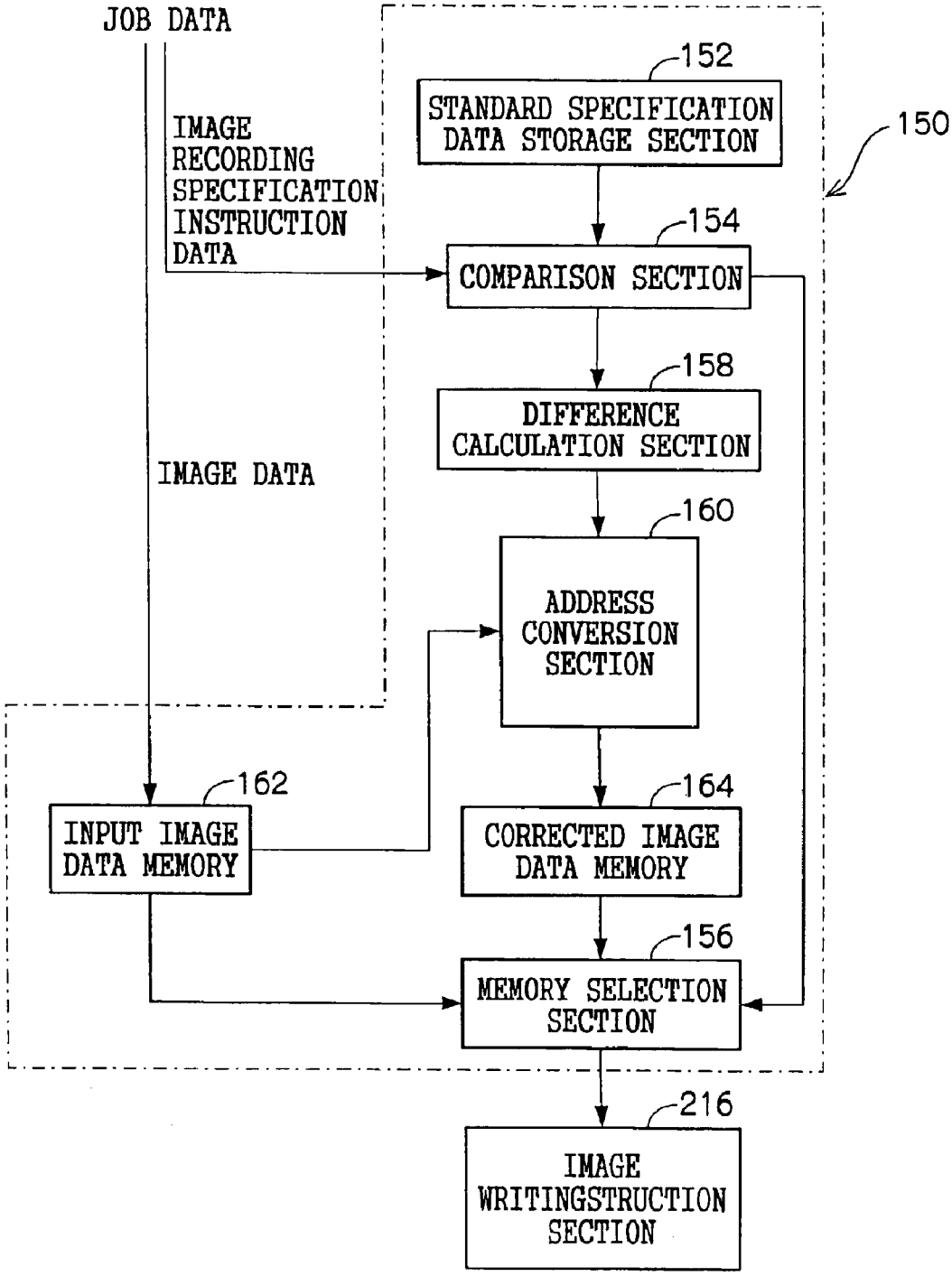
FIG. 4 is a schematic block diagram of an image data processing section of the first embodiment.

As shown in FIG. 4, a standard specification data storage section 152 is provided at the image data processing section 150. Data of standard specifications is stored at the standard specification data storage section 152 in advance.

For the light source unit 222 relating to the present embodiment, standard image recording specifications are set to a number of light sources (number of channels) of the light source unit 222 of 31 channels (31 ch), and a resolution during image recording of 2400 dpi (10.58 $\mu$m).

Figure 5A:
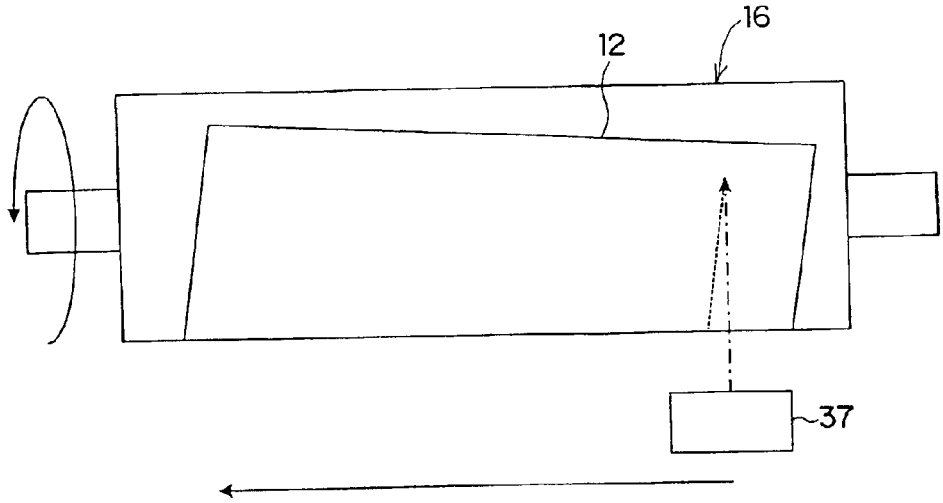
FIG. 5A is an elevational view showing a state in which a printing plate is inclined and wound onto a rotating drum.

Moreover, a main scanning direction size is 500 mm (47,259 pixels). The printing plate 12 is wound on the rotating drum 16 so as to be inclined on the basis of these specifications (see FIG. 5A).

Figure 5B:
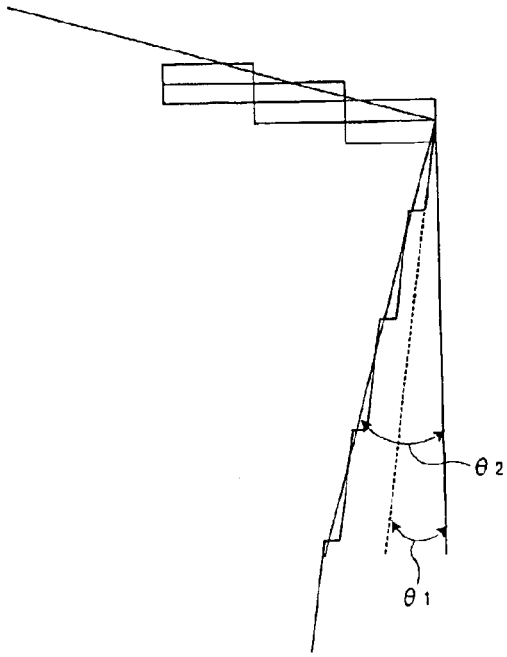
FIG. 5B is a plan view showing an image writing state.

That is, given the standard specifications, when the rotating drum 16 rotates in the main scanning direction and the recording head section 37 moves in the sub-scanning direction, which is the axial direction of the rotating drum 16, a movement track is such that image-recording lines are drawn in a helical form. This helix (an image-recording direction) is inclined by precisely a predetermined angle $\theta 1$ with respect to peripheral end edges of the rotating drum 16 (see FIG. 5B).

With the aforementioned image-recording specifications, the angle $\theta 1$ can be expressed by the following equation.

$$\tan \theta 1 = (\text{number of channels} \times \text{sub-scanning pitch}) / \text{main scanning direction size} \quad (1)$$

If the above-described values of the standard specifications for image-recording are used:

$$\tan \theta 1=(31\times 10.58)/500000=655.96\times 10^{-6}$$

Based on this value, θ1 is found ($\tan^{-1}\theta 1$), and hardware structures such as the mechanism for delivering the printing plate 12, positioning pins and the like are specified such that the printing plate 12 is wound on the peripheral surface of the rotating drum 16 at an angle of precisely θ1. As a result, the helixes (the image-recording direction) when recording an image at 2400 dpi can be made parallel to peripheral end edges along the direction of winding of the printing plate 12.

The standard specification data storage section 152 is connected to a comparison section 154. At the comparison section 154, instruction data representing actual image recording specifications is inputted and compared with the standard specification data.

A comparison result of the comparison section 154 falls into two categories, i.e., whether there is a difference between the standard specification data and the actual instruction data or not. This result is transmitted to a memory selection section 156. The memory selection section 156 is connected to the image writingstruction section 216 (see FIG. 3).

If, at the comparison section 154, it is determined that there is a difference, a signal thereof is transmitted to a difference calculation section 158.

At the difference calculation section 158, a difference between the standard specification data and the actual instruction data is calculated as a numerical value.

The calculated difference is inputted to a writing address conversion section 160. The writing address conversion section 160 functions to acquire image data from an input image data memory 162, which stores inputted image data, to convert addresses, and to store the image data at a corrected image data memory 164.

The input image data memory 162 and corrected image data memory 164 employ SDRAM (a burst transfer-capable storage device) for 16-bit wide four-stage bursts. That is, 64 pixels (of binary data) are dealt with in a single transfer.

The corrected image data memory 164 is connected to the memory selection section 156, and the input image data memory 162 is also connected to the memory selection section 156. Hence, if the signal that there is no difference is inputted to the memory selection section 156 from the comparison section 154, the memory selection section 156 acquires image data from the input image data memory 162, and if the signal that there is a difference is inputted from the comparison section 154, the memory selection section 156 acquires image data from the corrected image data memory 164.

As an example, if image recording is to be executed at 1200 dpi, which is not the standard specification, then, because the inclination angle θ1 of the printing plate 12 is determined in hardware (including mechanical structures), an image region at the specified inclination angle θ1 will produce distorted results.

Accordingly, in the present embodiment, an inclination angle θ2 for 1200 dpi is calculated on the basis of the aforementioned equation (1).

Given that other parameters (the number of channels and the main scanning direction size) are the same as before:

$$\tan \theta 2=(31\times 21.06)/500000=13311.92\times 10^{-6}$$

At 1200 dpi, a difference relative to 2400 dpi is:

$$\tan \theta 2-\tan \theta 1=655.96\times 10^{-6}$$

Based on this difference, the writing address conversion section 160 converts addresses and generates corrected image data, in which the image signals are shifted in the sub-scanning direction. Thus, distortion of the image region at 1200 dpi can be suppressed.

To describe this shifting in more detail, in the case described above, it is necessary to incline the data by precisely a difference in the main scanning direction (=tan θ2−tan θ1=$655.96\times 10^{-6}$). A shifting amount in the sub-scanning direction is $500{,}000\times 655.96\times 10^{-6}$, and is thus $327.98\times 10^{-6}$=327.98 μm. Hence, 327.98/10.58=31 (pixels).

That is, image signals are supplied to an exposure optical system so as to be shifted by 31 pixels in the sub-scanning direction while an image is formed in the main scanning direction.

Because there are 47,259 pixels in the main scanning direction, the main scanning direction is shifted one pixel (one channel) in the sub-scanning direction for each incidence of 47259/31=1524 pixels.

A table is provided which holds main scanning pixels as far as a one-pixel shift in the sub-scanning direction. In the aforementioned case of 1524 pixels, a shift pixel count 0 shown in FIG. 6 is specified. Then main scanning pixel counts until a one-pixel (one-channel) shift are serially computed as results, and thus a main scanning shift pixel counts table is set up.

The input image data memory 162 and corrected image data memory 164 employ SDRAM for 16-bit wide 4-stage bursts, and a table for reference of writing and reading addresses is prepared at the writing address conversion section 160. Values are specified in this table, the table is referred to during image writing and reading, and addresses are adjusted during image writing and reading.

In the above-described case of 1,524 pixels, 1524/64=23.18≈24. Accordingly, addresses are altered once for each incidence of 24 memory access cycles.

Figure 6A:
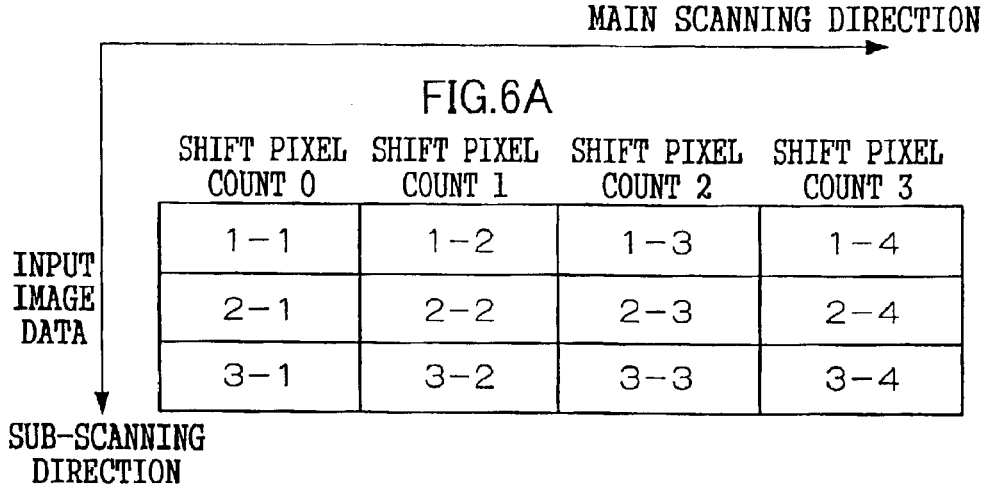
FIGS. 6A to 6C are plan views showing memory structure of image data and states of conversion of addresses for writing to a corrected image data memory in the first embodiment.
Figure 6B:
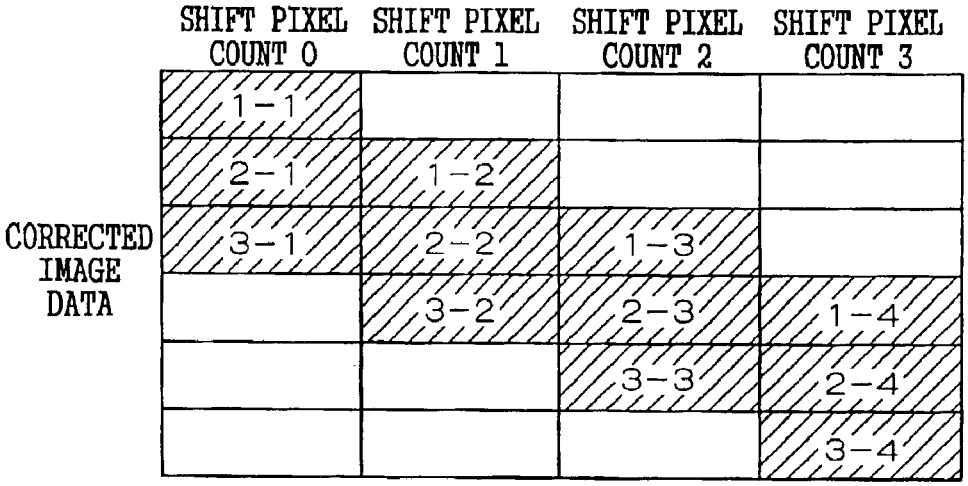
Figure 6C:
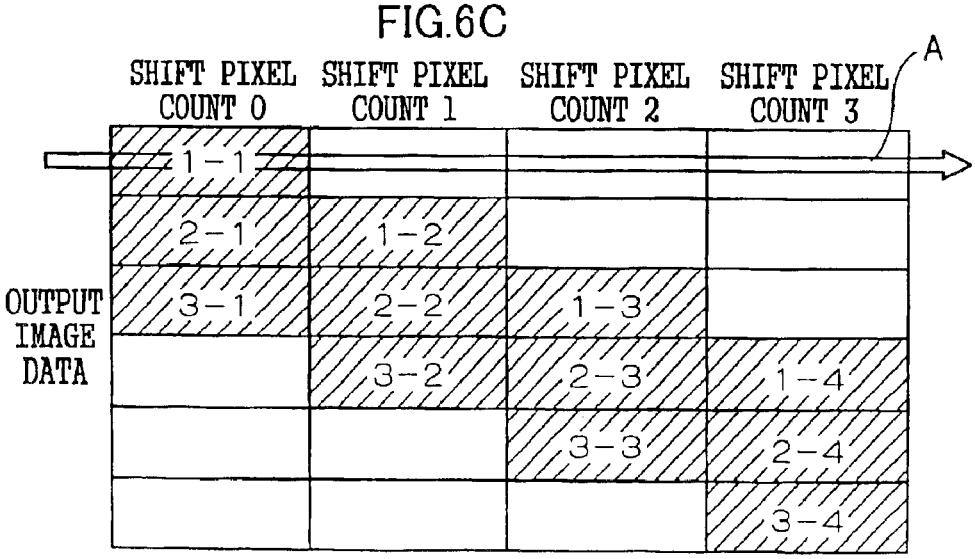

FIG. 6A is for illustrating an arrangement of image data stored in the input image data memory 162. FIG. 6B is for illustrating corrected image data whose addresses have been altered at the writing address conversion section 160 and which is stored in the corrected image data memory 164. FIG. 6C is an illustrative diagram showing a reading direction when the memory selection section 156 selects the corrected image data memory 164. Pixel counts in the main scanning direction are partitioned into four stages in this example, but a number of partition stages is not limited to four.

As shown in FIG. 6A, in the input image data memory 162, the image data is divided between addresses represented by predetermined stage-channel identification numbers (1-1, 1-2, 1-3, 2-1, . . . 3-4) in a regular arrangement. Here, as shown in FIG. 6B, each stage number is shifted by one channel unit at the writing address conversion section 160.

Correspondingly, as shown in FIG. 6C, image data that is to be transmitted to the image writingstruction section 216 is read from the image data in a horizontal direction as shown by the broad arrow A. As a result, reading of the image data is delayed in units of the stage numbers.

Below, operation of the present embodiment will be described.

Operations of the printing plate automatic exposure device 150 are as follows.

The printing plate 12 on the supply guide 20 is fed to the rotating drum 16, and a leading end portion of the printing plate 12 is retained by the leading end chuck 26. In this state, the rotating drum 16 rotates and the printing plate 12 is tightly wound onto the peripheral surface of the rotating drum 16. Thereafter, the trailing end of the printing plate 12 is retained by the trailing end chuck 36, and thus preparation for exposure is completed.

In this state, image data is read in, and exposure processing by the light beam from the recording head section 37 is begun. This exposure processing is "scanning exposure", in which the recording head section 37 moves in the axial direction of the rotating drum 16 while the rotating drum 16 rotates at high speed (main scanning).

When the exposure processing has finished, the conveyance guide unit 18 switches (the ejection guide 22 is made to correspond with the rotating drum 16), and then the printing plate 12 wound on the rotating drum 16 is ejected along the tangential direction. At this time, the printing plate 12 is fed to the ejection guide 22.

When the printing plate 12 has been fed to the ejection guide 22, the conveyance guide unit 18 switches, the ejection guide 22 is made to correspond with an ejection port, and the printing plate 12 is ejected. A developing section is provided along this direction of ejection, and the printing plate 12 continues on to undergo developing processing.

Now, in the present embodiment, when the printing plate 12 is preparatorily wound on the rotating drum 16, the printing plate 12 is angled for winding on the basis of the number of channels, resolution and the like that are specified as standard specifications. This inclination and winding is carried out by hardware including mechanical structures such as the feeding mechanism, positions of positioning pins and the like. Therefore, the winding is always performed at a constant inclination angle.

Consequently, when image recording is performed under the standard specifications, even though the image-recording lines have movement tracks with a helical form, the image region will not be distorted, and peripheral ends of the printing plate 12 and peripheral ends of the image region can be made to be mutually parallel.

Figure 7:
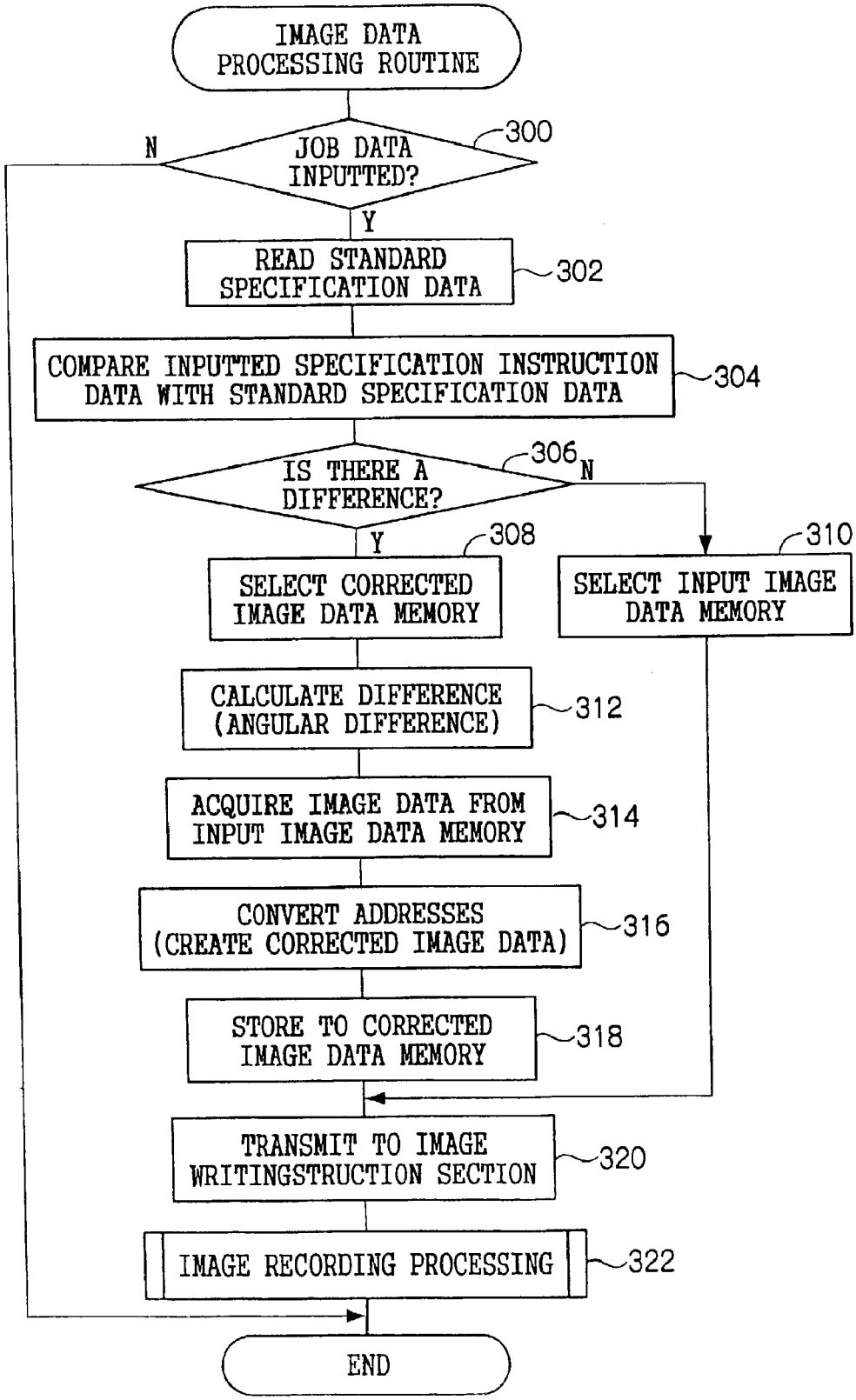
FIG. 7 is a control flowchart showing an image data processing routine of the first embodiment.

On the other hand, if there are instructions for specifications different from the standard specifications, then, because the inclination angle of the printing plate 12 cannot be changed, a conventional image region would be distorted. Accordingly, in the present embodiment, when there are such instructions for specifications that differ from the standard specifications, the image data is shifted in the sub-scanning direction by software processing, and distortion is alleviated. Next, an image data processing routine will be described in accordance with the flowchart of FIG. 7.

In step 300, it is determined whether or not job data (that is, image recording specifications instruction data and image data) has been inputted. If the determination is positive, control advances to step 302, and the standard specification data is read from the standard specification data storage section 152. Next, control advances to step 304, and the inputted instruction data for the specifications is compared with the standard specification data.

In step 306, the result of the comparison is judged, and if it is determined that there is a difference, it is determined that the image data requires correction and control advances to step 308. If it is determined in step 306 that there is no difference, then it is determined that correction of the image data is not required and control advances to step 310.

In step 308, a selection of the memory selection section 156 is set to the corrected image data memory 164, and control advances to step 312. Alternatively, in step 310, the selection of the memory selection section 156 is set to the input image data memory 162.

In step 312, the difference is calculated. Then, in step 314, the image data is acquired from the input image data memory 162.

In a next step 316, at the writing address conversion section 160, addresses of the acquired image data are altered on the basis of results of the calculation of the difference, and corrected image data is created.

In a next step 318, the corrected image data that has been created is stored in the corrected image data memory 164, and control advances to step 320.

In contrast, in the case in which the input image data memory 162 has been selected in step 310, control advances directly to step 320.

In step 320, image data is transmitted to the image writingstruction section 216 from either memory (the corrected image data memory 164 or the input image data memory 162), control advances to step 322, and image recording processing is executed.

The flow of the routine described above will be described for a standard specification of 2400 dpi and an actual input specification of 1200 dpi.

For the standard specification, the angle θ1 is such that, based on the aforementioned equation (1), $\tan \theta 1=(31\times 10.58)/500000=655.96\times 10^{-6}$.

Now, in the case in which the inputted specification instruction is 1200 dpi, the angle θ2 is such that, based on equation (1), $\tan \theta 2=(31\times 21.06)/500000=13311.92\times 10^{-6}$.

For 1200 dpi, the difference relative to 2400 dpi is $$\tan \theta 1-\tan \theta 2=655.96\times 10^{-6}.$$

Based on this difference, the writing address conversion section 160 alters the addresses, the image signals are shifted in the sub-scanning direction, and the corrected image data is created. Thus, even at 1200 dpi, distortion of the image region can be suppressed.

For altering the addresses, as shown in FIG. 6A, at the input image data memory 162, the image data is divided between addresses represented by predetermined stage-channel numbers (1-1, 1-2, 1-3, 2-1, . . . 3-4), and is arranged regularly. As shown in FIG. 6B, on the basis of the difference calculation results, the writing address conversion section 160 shifts this data one-channel unit for each stage.

Consequently, as shown in FIG. 6C, the image data that is to be transmitted to the image writingstruction section 216 is read from the image data in the horizontal direction shown by the broad arrow A. Thus, as a result, reading of the image data is delayed in stage units, and image recording can be carried out at the instructed specifications without distortion occurring.

Note that, in cases of image recording other than at standard specifications herein, it is preferable to also correct image-writing timings of main scanning. Below, control of a main scanning image-writing timing will be described.

The inclined winding of the printing plate 12 leads to shifting of starting positions of main scanning of an image recording region.

In this embodiment, starting positions of the image-writing are offset in units of individual cycles of main scanning.

A maximum offset amount can be obtained from a length W (sub-scanning total width), from a starting position of a first scanning line to a starting position of a last scanning line during writing of an image, and the inclination angle θ (the aforementioned θ1 or θ2).

That is, if the offset amount is $L_{OS}$:

$$W/L_{OS}=\tan \theta \tag{2}$$

and so:

$$L_{OS}=W/\tan \theta \tag{3}$$

This offset amount $L_{OS}$ is divided by the number of main scanning cycles, and the offset amount $L_{OS}$ is distributed between the respective main scans (into respective offset amounts $L_{OS/E}$). Furthermore, the total offset amount $L_{OS}$ is subject to limitation in accordance with the resolution. That is, in a case in which a limit value $L_{LT}$> the offset amount $L_{OS}$, $L_{OS}$ is set to $L_{OS}$, but in a case in which the limit amount $L_{LT}$ the offset amount $L_{OS}$, $L_{OS}$ is set to equal $L_{LT}$. Thus, offsetting is implemented in a range not exceeding the limit value.

Figure 8:
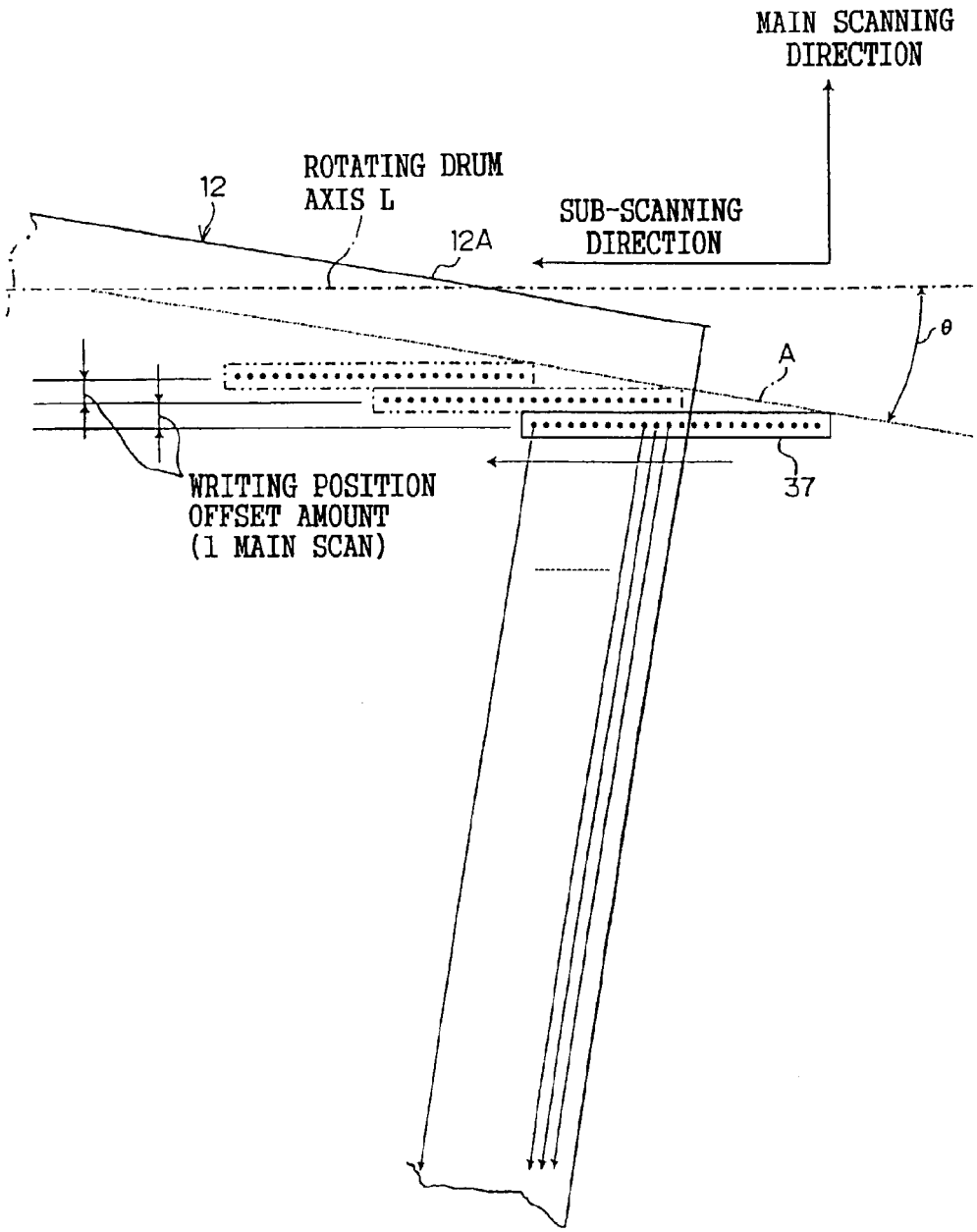
FIG. 8 is a front view of a printing plate showing main scanning writing positions of an image.
Figure 9A:
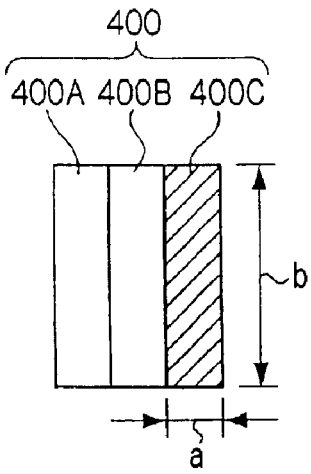
FIGS. 9A to 9F are explanatory views showing states of writing image data to memory, and of shifting.
Figure 9B:
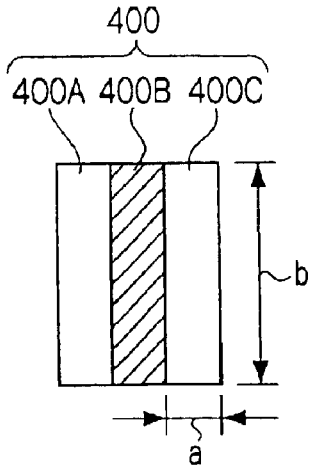
Figure 9C:
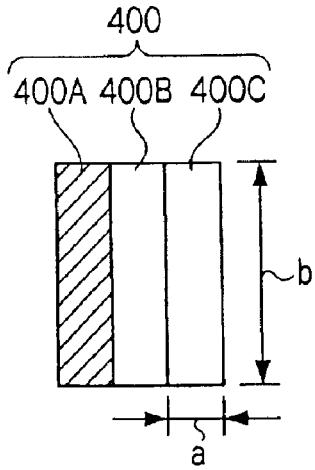
Figure 9D:
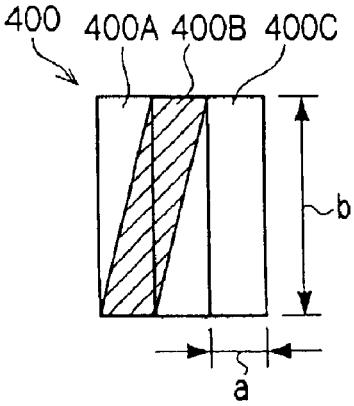
Figure 9E:
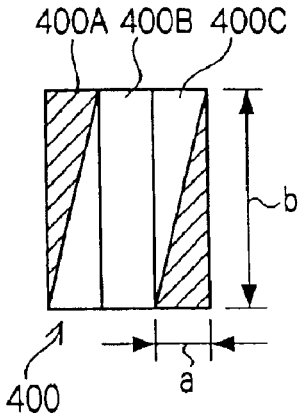
Figure 9F:
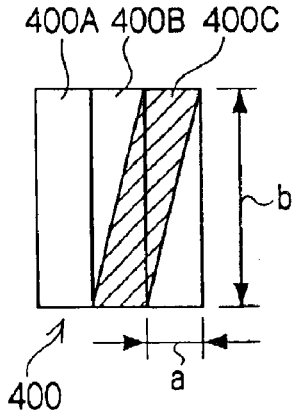
Figure 10:
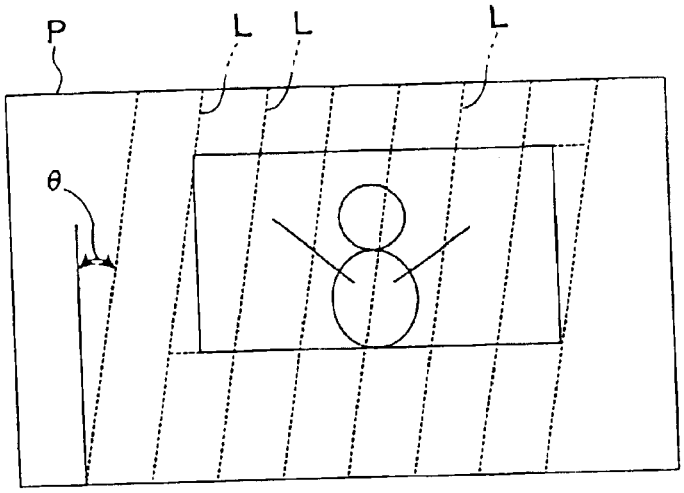
FIG. 10 is a plan view showing a state of inclination of a conventional image region with respect to a recording material.

The offset amount $L_{OS/E}$ for each main scan, obtained as described above, is recorded as a delay setting value. Hence, timing of commencement of image writing for each main scan is shifted (delayed) stepwise and, as shown in FIG. 8, a line joining starting positions of the respective main scanning lines (see the broken line A in FIG. 8) achieves a state of being substantially parallel with an edge 12A of the printing plate 12 that runs along the axis of the rotating drum 16.

Note that in the first embodiment described above, an example in which addresses for writing to the corrected image data memory 164 are converted has been illustrated. However, the present invention is not limited thus. Both these writing addresses and the reading addresses, or just the reading addresses, may be converted. Cases in which conversion of the reading addresses is carried out are illustrated below as a second and third embodiment. Note that in the second and third embodiments, structural portions and processes that are the same as in the first embodiment are given the same reference numerals, and explanations thereof are omitted.

Figure 11:
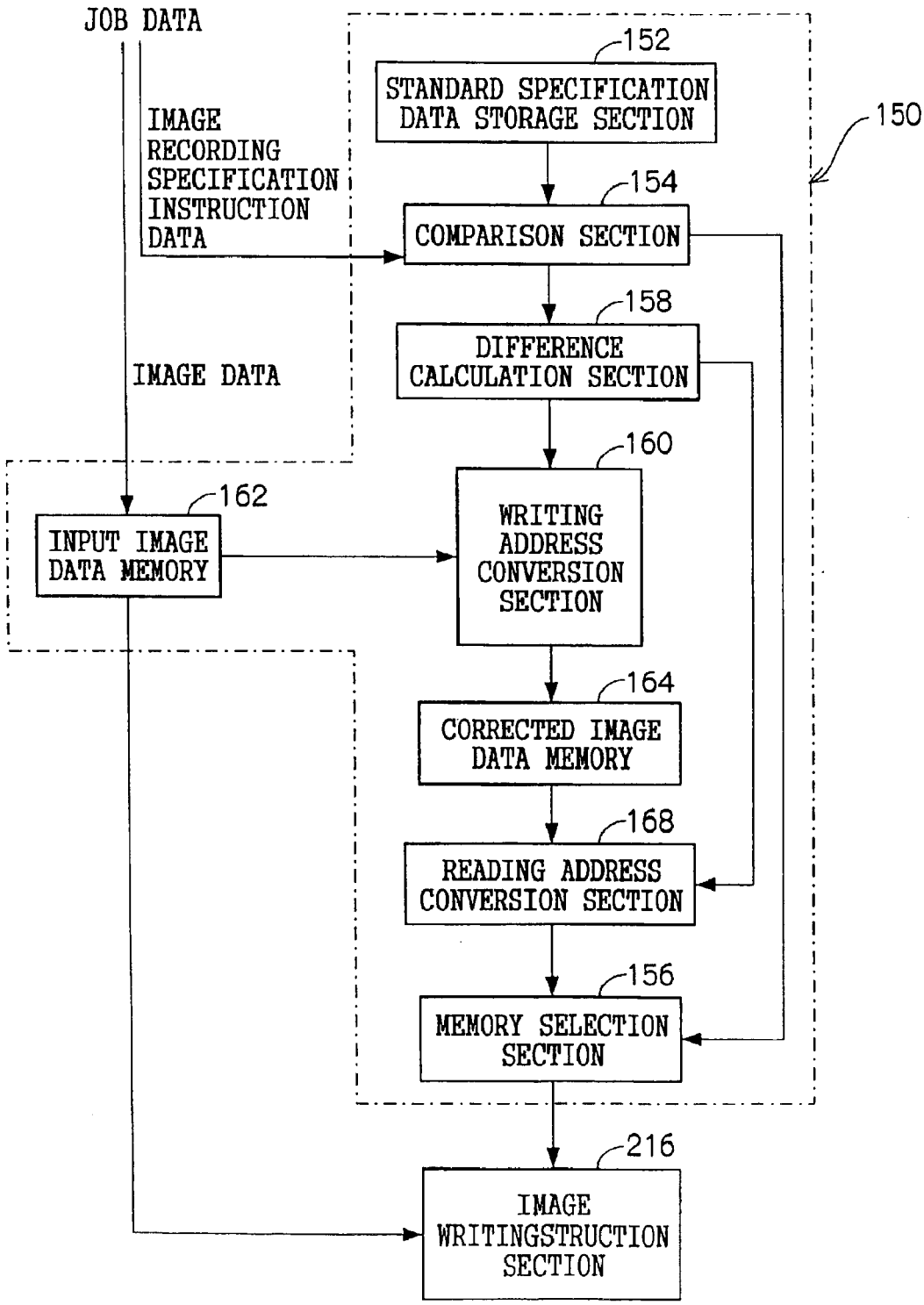
FIG. 11 is a schematic block diagram of an image data processing section of a second embodiment.

In the second embodiment, as shown in FIG. 11, the difference between the standard specification data and the actual data, which is calculated at the difference calculation section 158, is inputted to the writing address conversion section 160 and a reading address conversion section 168. The writing address conversion section 160 reads image data from the input image data memory 162, which stores the inputted image data, converts the addresses, and stores the image data in the corrected image data memory 164. Subsequently, by converting addresses when reading the image data from the corrected image data memory 164, the reading address conversion section 168 reads the image data in a sequence different from the sequence in which the data was stored at the corrected image data memory 164.

For conversion of the writing addresses and the reading addresses, a number of pixel shifts in the sub-scanning direction for a single main scan is found from tan θ2−tan θ1, and address conversion is carried out such that a difference in sub-scanning direction shift pixel counts during writing and during reading is the desired number of sub-scanning direction pixel shifts.

Similarly to the first embodiment, the corrected image data memory 164 is connected to the memory selection section 156. The input image data memory 162 is also connected to the memory selection section 156. That is, at the memory selection section 156, if the signal that there is no difference is inputted from the comparison section 154, then the memory selection section 156 acquires the image data directly from the input image data memory 162, and if the signal that there is a difference is inputted from the comparison section 154, then the memory selection section 156 acquires the image data from the corrected image data memory 164.

Figure 13A:
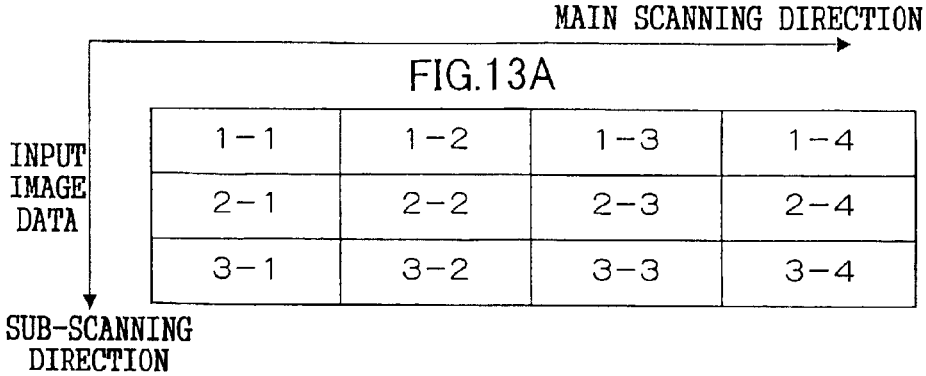
FIGS. 13A to 13D are plan views showing memory structure of image data and states of conversion of addresses for writing to a corrected image data memory and of image-writing address conversion in the second embodiment.
Figure 13B:
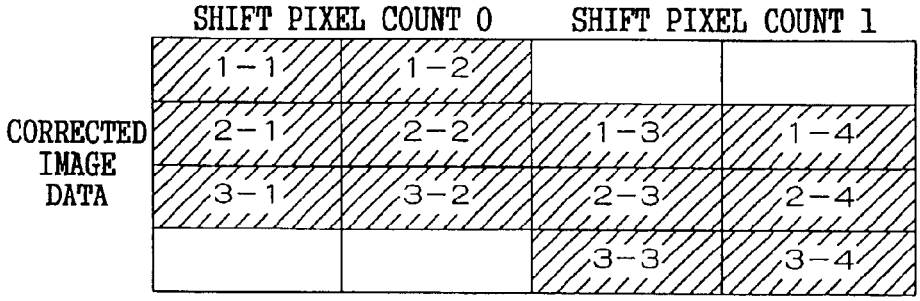
Figure 13C:
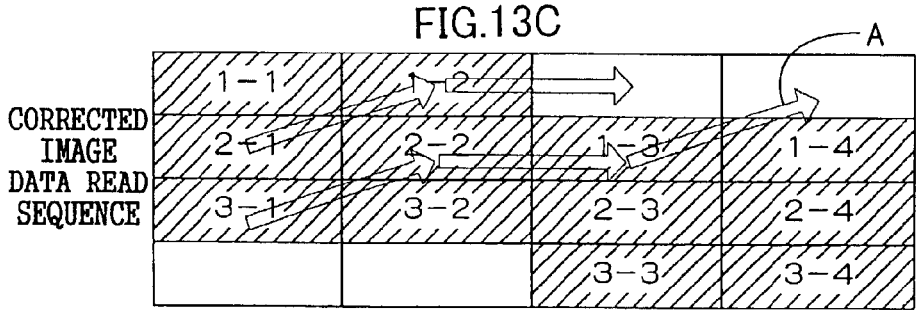
Figure 13D:
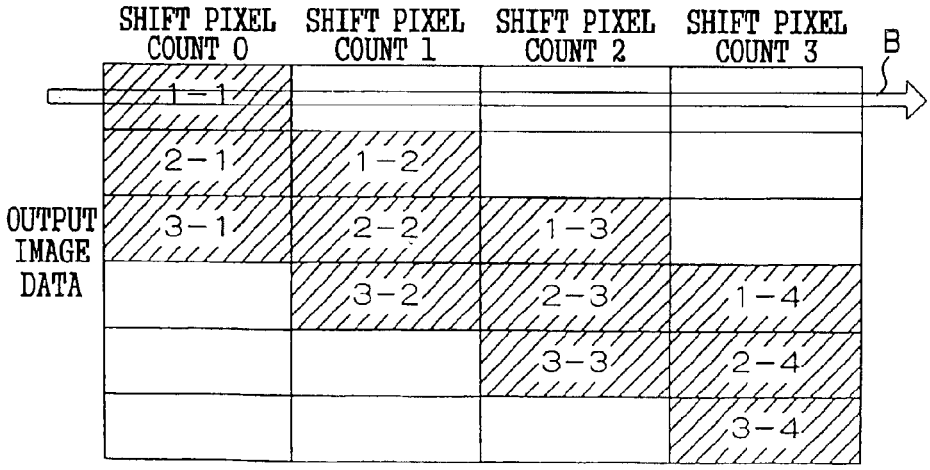

FIG. 13A is for illustrating an arrangement of image data stored at the input image data memory 162. FIG. 13B is for illustrating an arrangement of corrected image data, whose addresses have been converted by the writing address conversion section 160, stored at the corrected image data memory 164. FIG. 13C is for illustrating an arrangement of corrected image data at the corrected image data memory 164, similarly to FIG. 13B. Arrow A shows a reading sequence of the image data in accordance with conversion of reading addresses by the reading address conversion section 168. FIG. 13D is for illustrating an arrangement of image data supplied to the image writingstruction section 216 in a case in which the image data is read in the sequence of arrow A in FIG. 13C. An arrow B shows a sequence in which the output image data is supplied.

As shown in FIG. 13A, the image data is written to the input image data memory 162 so as to be shifted one pixel in the sub-scanning direction in accordance with a predetermined number of pixels in the main scanning direction. When the image data is to be read from the input image data memory 162, the image data is read in the sequence shown by arrow A in FIG. 13C, in accordance with the addresses converted at the reading address conversion section 168. As a result, the output image data transmitted to the image writingstruction section 216 is image data which is shifted by precisely a number of pixels that cancels out the difference between the standard specifications and the input specifications, as shown in FIG. 13D. For the example described for the first embodiment, with the standard specification of 2400 dpi and the input specification of 1200 dpi, the data is shifted 31 pixels in the sub-scanning direction for one cycle of main scanning to form the output image data. At regions for which image data does not exist when the corrected image data is to be read, as shown by the plain white portions of the output image in FIG. 13D, suitable values, for example, zero, are supplied such that inappropriate data is not included in the output image data.

Figure 12:
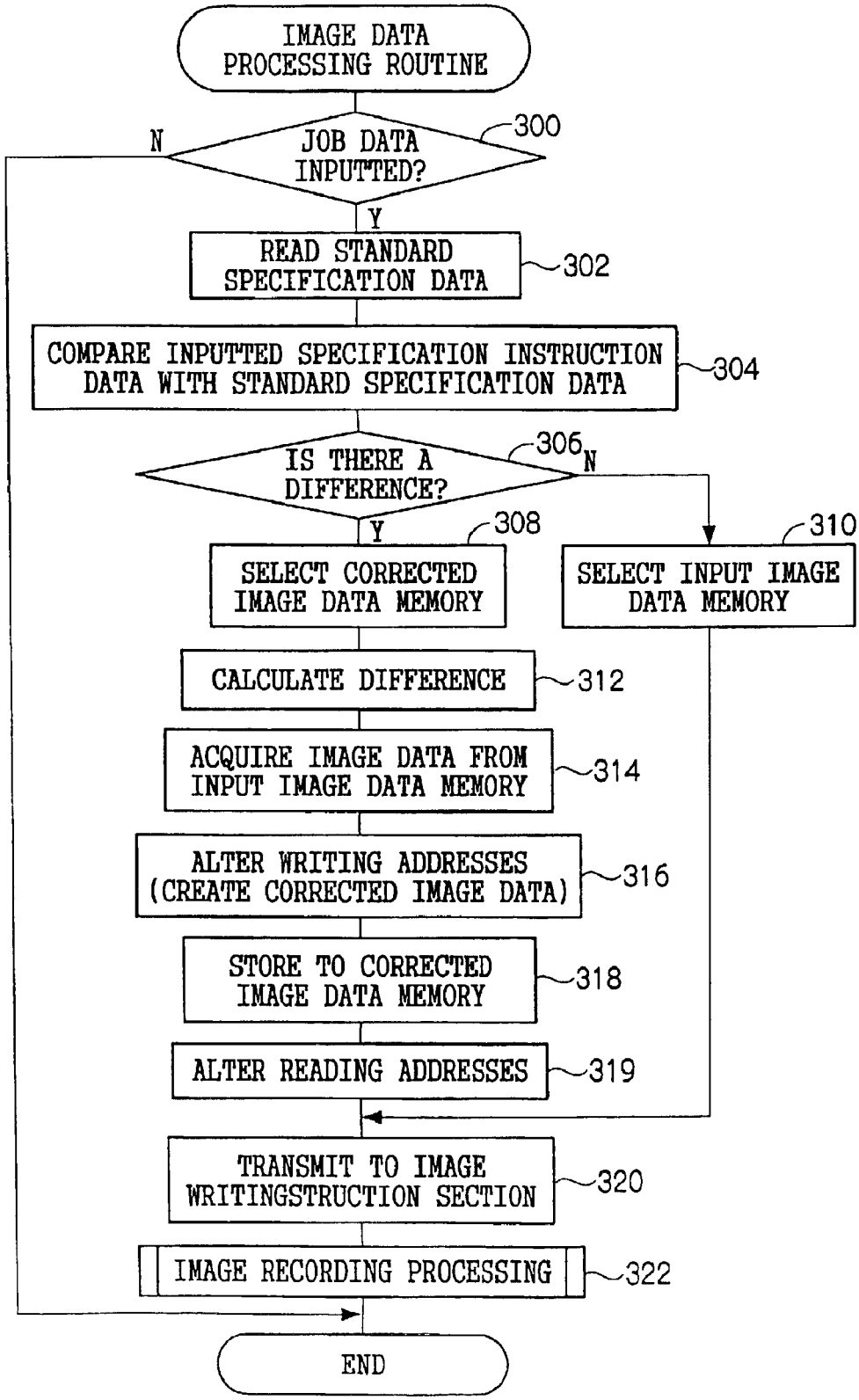
FIG. 12 is a control flowchart showing an image data processing routine of the second embodiment.

Next, an image data processing routine of the second embodiment will be described in accordance with the flowchart of FIG. 12.

In step 300, it is determined whether or not job data (that is, image recording specifications instruction data and image data) has been inputted. If the determination is positive, control advances to step 302, and the standard specification data is read from the standard specification data storage section 152. Next, control advances to step 304, and the inputted specification instruction data is compared with the standard specification data.

In step 306, the result of the comparison is judged, and if it is determined that there is a difference, it is determined that the image data requires correction, and control advances to step 308. If it is determined in step 306 that there is no difference, then it is determined that correction of the image data is not required, and control advances to step 310.

In step 308, the selection of the memory selection section 156 is set to the corrected image data memory 164, and control advances to step 312. Alternatively, in step 310, the selection of the memory selection section 156 is set to the input image data memory 162.

In step 312, the difference is calculated. Then, in step 314, the input image data is acquired from the input image data memory 162.

In the next step 316, at the writing address conversion section 160, addresses of the acquired input image data are converted on the basis of results of the calculation of the difference, and the corrected image data is created.

In step 319, the reading address conversion section 168 alters the reading sequence of the image data by changing addresses of reading when the image data is to be read from the corrected image data memory 164. This reading address conversion is carried out such that a difference between a pixel shifting amount due to the writing address conversion in step 316 and a pixel shifting amount due to this reading address conversion in step 319 approaches a pixel shifting amount that corresponds to the difference between the standard specifications and the input specifications calculated in step 312.

In contrast, in the case in which the input image data memory 162 has been selected in step 310, control advances directly to step 320.

In step 320, image data is transmitted to the image writingstruction section 216 from either memory (the corrected image data memory 164 or the input image data memory 162), control advances to step 322, and image recording processing is executed.

The second embodiment may create a writing address conversion table in advance, such that a shift of pixel counts, which corresponds to a difference between the standard specifications and specifications that, second to the standard specifications, are most often selected (second standard specifications), is carried out at the time of writing to the corrected image data memory 164. If the second standard specifications are selected, writing to the corrected image data memory 164 is carried out by the writing address conversion section 160 with reference to this writing address conversion table. Thus, at the time of reading, reading from the corrected image data memory 164 can be performed without converting reading addresses.

If specifications other than the standard specifications and the second standard specifications are selected, then, when the image data is written to the corrected image data memory 164, the writing addresses are converted with reference to the writing address conversion table for the second standard specifications and, at the time of reading, the reading address conversion may be carried out such that the difference between a pixel shifting amount due to the writing address conversion and a pixel shifting amount due to the reading address conversion cancels out the difference between the standard specifications and the input specifications.

Figure 14:
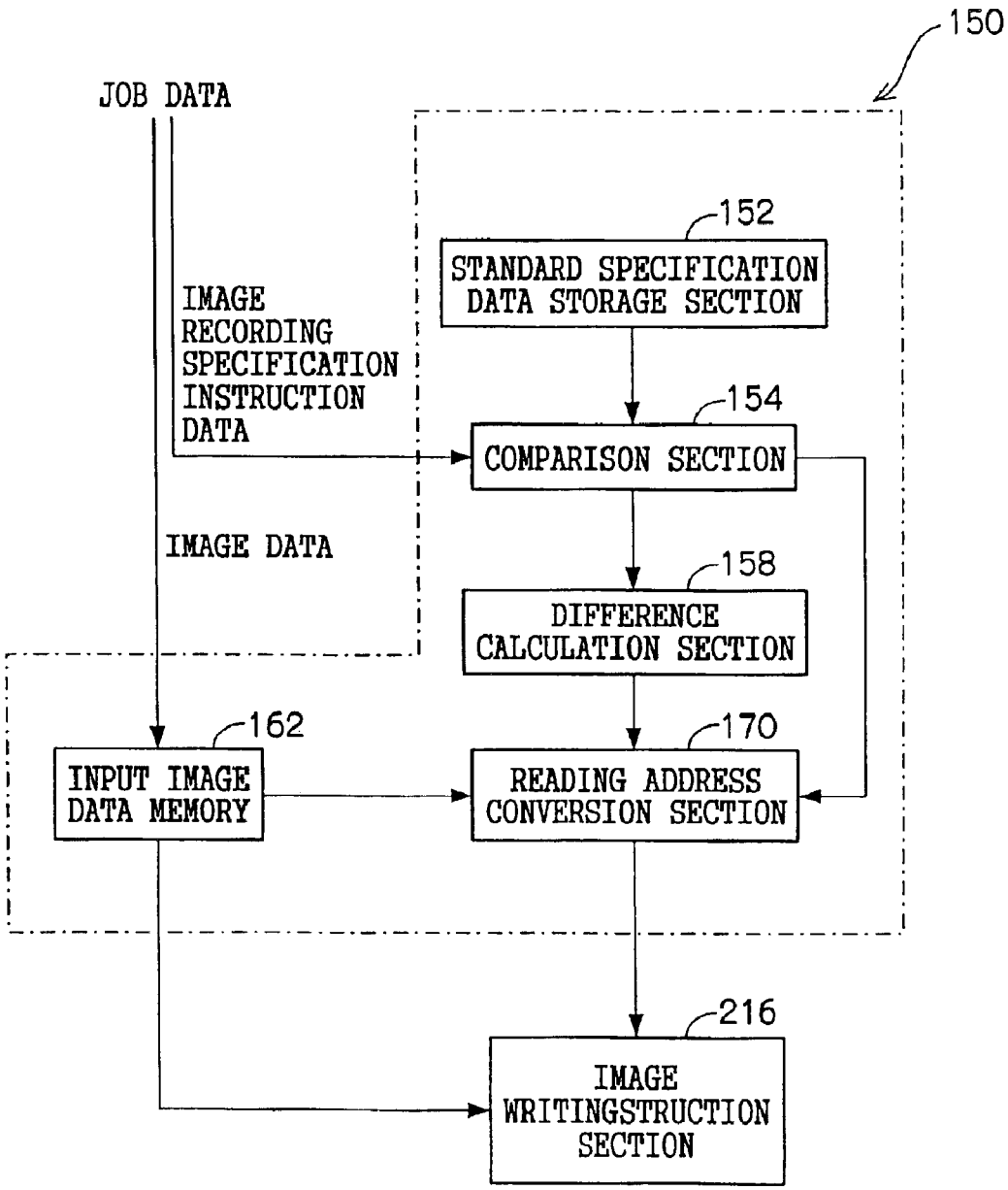
FIG. 14 is a schematic block diagram of an image data processing section of a third embodiment.

In the third embodiment, as shown in FIG. 14, the difference between the standard specification data and the actual instruction data is calculated as a value at the difference calculation section 158.

The calculated difference is inputted to a reading address conversion section 170. If the signal that there is no difference is inputted to the reading address conversion section 170 from the comparison section 154, a sequence of reading of image data from the input image data stored at the input image data memory 162 is not altered. If the signal that there is a difference is inputted from the comparison section 154, the reading address conversion section 170 finds pixel numbers for shifting in the sub-scanning direction from tan θ2−tan θ1, designates reading addresses on the basis thereof, and hence alters the reading sequence of the inputted image data.

Figure 16A:
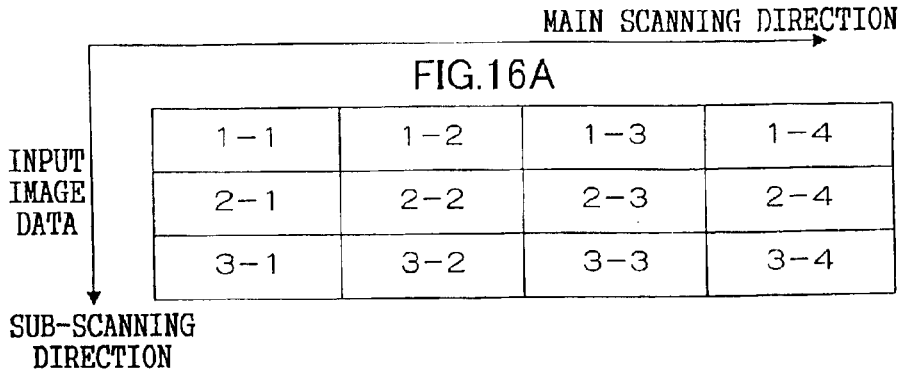
FIGS. 16A to 16D are plan views showing memory structure of image data and states of designation of addresses for reading from an input image data memory.
Figure 16B:
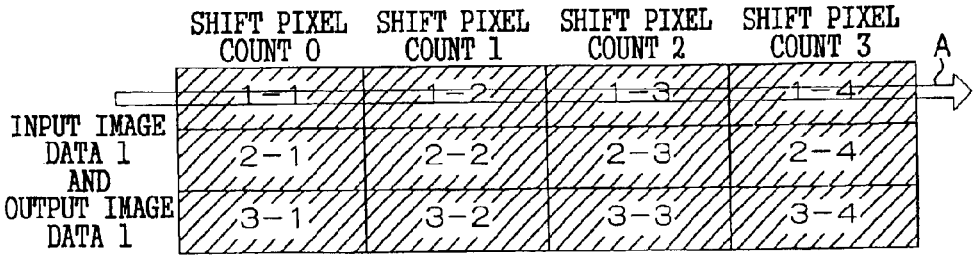

In the third embodiment, if the inputted specifications are the same as the standard specifications, then, as shown in FIG. 16B, the data stored in the input image data memory 162 is read in the main scanning direction in the sequence in which the data was stored, as shown by arrow A. Consequently, the arrangement of the output image data is the same as the arrangement of the input image data.

Figure 16C:
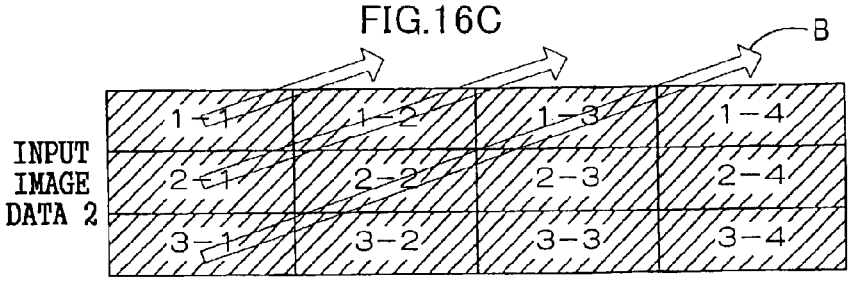
Figure 16D:
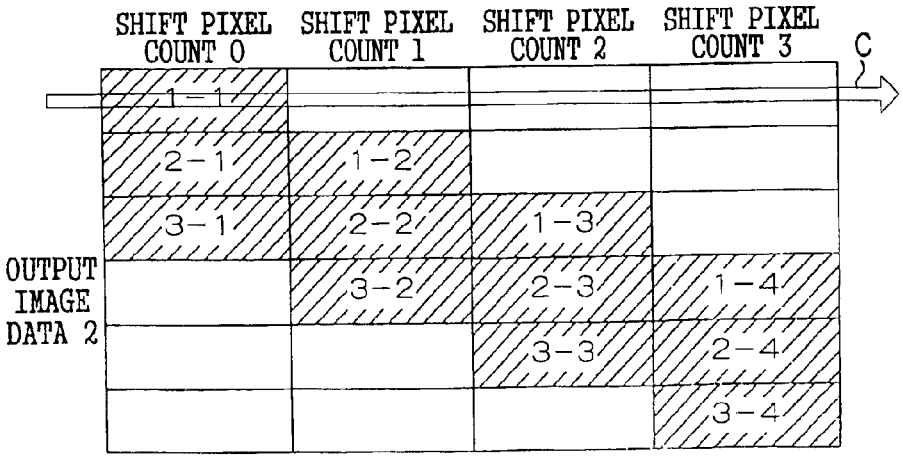

On the other hand, if the inputted specifications differ from the standard specifications, then, as shown in FIG. 16C, the data stored in the input image data memory 162 is read in the sequence converted by the reading address conversion section 170, as shown by arrow B. In this case, as shown in FIG. 16D, the output image is supplied to the image writingstruction section 216 in the sequence shown by arrow C. For the example explained for the first embodiment, with the standard specification of 2400 dpi and the inputted specification of 1200 dpi, the data is shifted 31 pixels in the sub-scanning direction for a single cycle of scanning in the main scanning direction to form the output image data. At regions for which image data does not exist when the input image data is to be read, as shown by the plain white portions of the output image in FIG. 16D, suitable values, for example, zero, are supplied such that inappropriate data is not included in the output image data.

Figure 15:
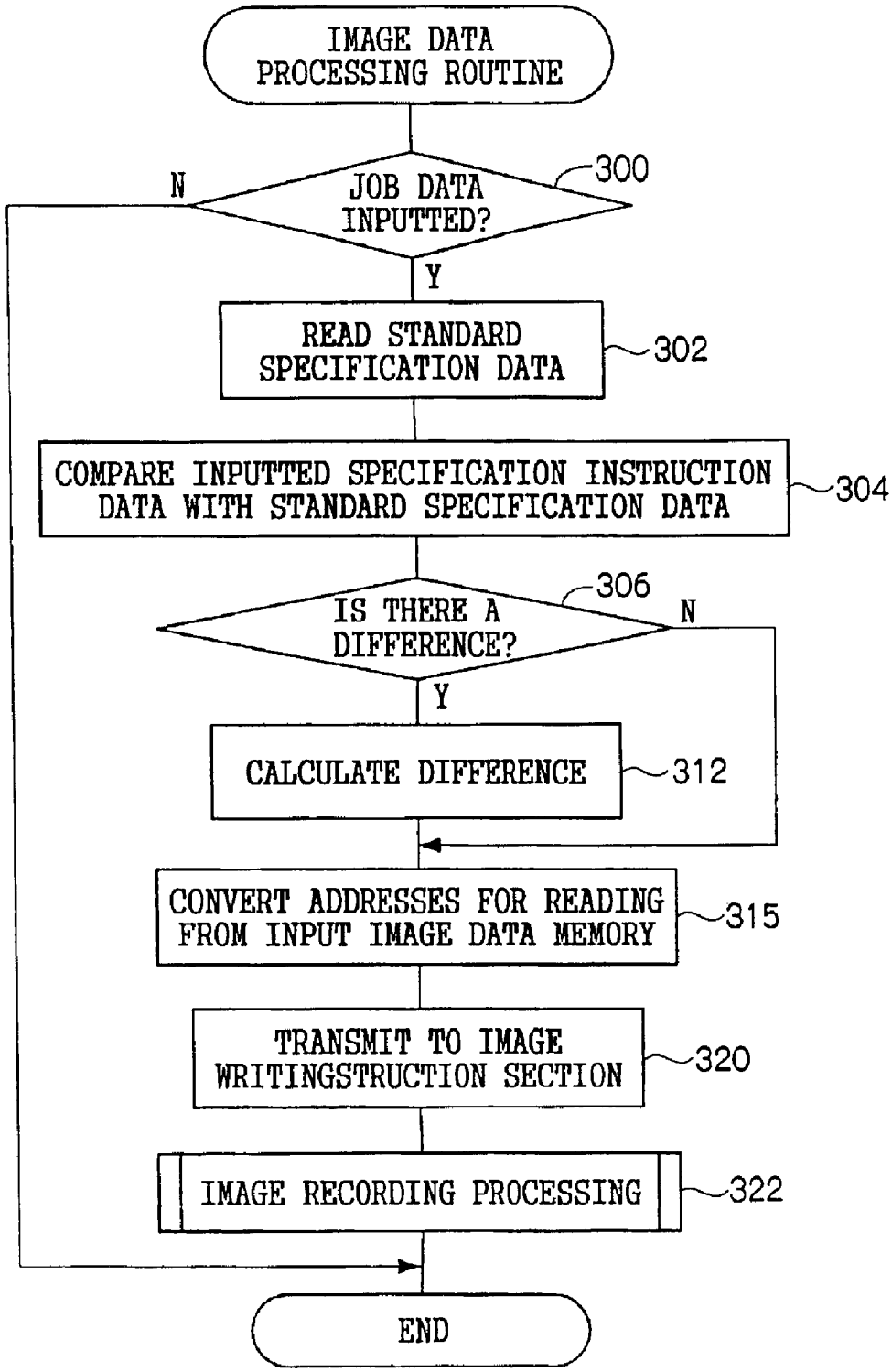
FIG. 15 is a control flowchart showing an image data processing routine of the third embodiment.

Next, an image data processing routine of the third embodiment will be described in accordance with the flowchart of FIG. 15.

In step 300, it is determined whether or not job data (that is, image recording specifications instruction data and image data) has been inputted. If the determination is positive, control advances to step 302, and the standard specification data is read from the standard specification data storage section 152. Then control advances to step 304, and the inputted instruction data for the specifications is compared with the standard specification data.

In step 306, the result of the comparison is judged, and if it is determined that there is a difference, control advances to step 312. In step 312, the difference is calculated. In step 315, reading addresses are designated on the basis of the difference computed in step 312, such that the sequence of reading image data from the input image data memory 162 is altered. In step 320, image data is transmitted from the input image data memory 162 to the image writingstruction section 216 in the sequence designated in step 315. Next, control advances to step 322, and image recording processing is executed.

Alternatively, if it is determined in step 306 that there is no difference, processing advances to step 315. In step 315, alteration of the reading addresses is not carried out, but addresses are designated as reading addresses in the order of storage at the input image data memory 162. In step 320, the image data is transmitted from the input image data memory 162 to the image writingstruction section 216 in the sequence of the order of storage at the input image data memory 162, which was designated in step 315. Then control advances to step 322, and image recording processing is executed.

In the second and third embodiments, timing/position of commencement of image-writing main scanning may be corrected in the same manner as in the first embodiment.

In the first, second and third embodiments, the printing plate 12 is wrapped onto the rotating drum 16 such that peripheral end edges of the printing plate 12 are inclined by precisely a predetermined angle with respect to peripheral end edges of the rotating drum 16 (in the main scanning direction), based on the number of channels, resolution and the like specified for the standard specifications. Further, the recording head main body 37A moves along the shaft 204 in the axial direction of the rotating drum 16. However, the winding angle of the printing plate 12 and the movement direction of the recording head main body 37A are not limited thus.

For example, the printing plate 12 may be wrapped onto the rotating drum 16 such that the peripheral end edges of the printing plate 12 are parallel to the peripheral end edges of the rotating drum 16 (in the main scanning direction), and the shaft 204 may be inclined such that the movement direction of the recording head main body 37A is inclined at precisely a predetermined angle with respect to the axial direction of the rotating drum 16. This predetermined angle is calculated on the basis of the number of channels, resolution and the like specified for the standard specifications.

Furthermore, the peripheral end edges of the printing plate 12 may be not parallel with the peripheral end edges (in the main scanning direction) of the rotating drum 16, with the movement direction of the recording head main body 37A being inclined at precisely a predetermined angle with respect to the axial direction of the rotating drum 16. In this case, a relative angular difference, between the angle between the peripheral end edges of the printing plate 12 and the peripheral end edges of the rotating drum 16 and the angle between the movement direction of the recording head main body 37A and the axial direction of the rotating drum 16, is calculated on the basis of the number of channels, resolution and the like which are specified as the standard specifications.

The present invention as described above has excellent effects in that, given a predetermined number of channels of a light beam that are simultaneously irradiated from a recording head and a predetermined resolution, by preparatorily inclining and positioning a recording material in correspondence with an angle which cancels out an inclination angle between peripheral ends of the recording material and peripheral ends of an image region, which inclination angle is caused by simultaneous progress in a main scanning direction and a sub-scanning direction, shifting of image-recording positions (inclination of an image) can be eliminated with a comparatively simple control system and shifting of image-recording positions can be eliminated by simple data processing, in software, when there is a change in image recording requirements (such as the resolution and/or number of channels).

What is claimed is:

1. An image-recording device which irradiates a light beam from a recording head on the basis of input image data while moving a recording material and the recording head simultaneously relatively in a main scanning direction and a sub-scanning direction, and records an image on the recording material, the image-recording device comprising:

a positioning section which, for a predetermined resolution and a predetermined number of channels of the light beam irradiated from the recording head simultaneously, preparatorily inclines and positions the recording material in correspondence with an angle which cancels out an inclination angle between a peripheral end of the recording material and a peripheral end of an image region, the inclination angle being caused by the simultaneous progress in the main scanning direction and the sub-scanning direction; and an image data shift section which, at a time of image recording under conditions in which at least one of a resolution and a number of channels differs from the predetermined resolution and the predetermined number of channels for which the positioning section has carried out positioning, shifts the input image data in the sub-scanning direction on the basis of the difference of the at least one of the resolution and the number of channels.

2. The image-recording device of claim 1, wherein the image data shift section comprises a storage section which stores the input image data in accordance with addresses which are designated on the basis of a difference from at least one of the predetermined resolution and the predetermined number of channels, and wherein, at the time of image-recording, the input image data is read on the basis of the addresses stored at the storage section.

3. The image-recording device of claim 2, wherein, in a case in which the resolution and number of channels at the time of image recording differ from the resolution and number of channels used as a standard at the time of storing at the storage section, and an angular difference occurs therebetween, addresses are altered in correspondence with the angular difference after the image data stored at the storage section has been read.

4. The image-recording device of claim 2, wherein the storage section employs a burst transfer-capable storage device.

5. The image-recording device of claim 1, further comprising a main scanning image-writing timing control section which, on the basis of the inclination angle of the recording material, specifies a time difference for a timing of commencement of image-writing the main scanning direction.

6. An image-recording device comprising:

a movement section which moves a recording material in a main scanning direction;

a recording apparatus which, while moving in a sub-scanning direction which intersects the main scanning direction, records an image at the recording material on the basis of supplied image data; and an image processing section which supplies image data to the recording apparatus, wherein the recording material is attached to the movement section such that a standard direction specified for the recording material includes a predetermined angle with respect to the main scanning direction, with the recording material being inclined at an angle corresponding to the predetermined angle with respect to the main scanning direction, and in a case in which a direction of image recording of the recording apparatus on the recording material at a time of simultaneous movement of the movement section and the recording apparatus is displaced from the standard direction, the image processing section supplies the image data to the recording apparatus having altered a predetermined recording sequence of a plurality of pixel data which form the image data to be supplied to the recording apparatus, so as to reduce shifting of image recording positions on the recording material, which shifting is caused by a difference between the image recording direction and the standard direction.

7. The image-recording device of claim 6, wherein the standard direction of the recording material is the same as the direction of image recording by the recording apparatus under predetermined recording conditions, and the image recording direction changes depending upon image recording conditions.

8. The image-recording device of claim 7, wherein the recording apparatus comprises a recording head and the recording conditions include a resolution and a number of channels of a light beam that are simultaneously irradiated from the recording head.

9. The image-recording device of claim 6, wherein the image processing section comprises:

an image data storage section which stores image data;

an address conversion section which, so as to reduce the shifting of image recording positions on the recording material due to the difference between the image recording direction and the standard direction, converts addresses of writing to the image data storage section on the basis of the difference; and a writing section which writes the image data to the image data storage section on the basis of the writing addresses that have been converted by the address conversion section.

10. The image-recording device of claim 9, wherein the address conversion section finds a predetermined number of pixels in the main scanning direction based on the difference between the image recording direction and the standard direction, and calculates the addresses of writing to the image data storage section such that the image data is stored at the image data storage section having been shifted by an amount corresponding to one pixel in the sub-scanning direction for each incidence in the main scanning direction of the predetermined number of pixels.

11. The image-recording device of claim 10, wherein the image data storage section comprises a burst transfer-capable storage device.

12. The image-recording device of claim 11, wherein the address conversion section finds a predetermined number of pixels in the main scanning direction until a one-pixel shift in the sub-scanning direction from the difference between the image recording direction and the standard direction, and converts the writing addresses such that the image data is written to the image data storage section having been shifted one pixel in the sub-scanning direction for each incidence in the main scanning direction of a number of pixels which is an integer multiple of a burst length of the burst transfer-capable recording device and which is closest to the predetermined number of pixels in the main scanning direction.

13. The image-recording device of claim 12, wherein the address conversion section carries out address conversion employing en address conversion table prepared in advance.

14. The image-recording device of claim 6, wherein the image processing section comprises:

an image data storage section which stores image data;

an address conversion section which, so as to reduce the shifting of image recording positions on the recording material due to the difference between the image recording direction and the standard direction, converts addresses for writing to the image data storage section and converts addresses for reading from the image data storage section on the basis of the difference;

a writing section which writes the image data to the image data storage section on the basis of the writing addresses that have been converted by the address conversion section; and a reading section which reads the image data from the image data storage section on the basis of the reading addresses.

15. The image-recording device of claim 14, wherein the image data storage section comprises a burst transfer-capable storage device, and the address conversion section carries out address conversion employing an address conversion table prepared in advance.

16. The image-recording device of claim 6, wherein the image processing section comprises:

an image data storage section which stores image data;

an address conversion section which, so as to reduce the shifting of image recording positions on the recording material due to the difference between the image recording direction and the standard direction, converts addresses for reading from the image data storage section on the basis of the difference; and a reading section which reads the image data from the image data storage section on the basis of the reading addresses that have been converted by the address conversion section.

17. The image-recording device of claim 16, wherein the image data storage section comprises a burst transfer-capable storage device, and the address conversion section carries out address conversion employing an address conversion table prepared in advance.

18. An image-recording device comprising:

a movement section which moves a recording material in a main scanning direction;

a recording apparatus which, while moving in a sub-scanning direction which intersects the main scanning direction, records an image at the recording material on the basis of supplied image data;

an image processing section which supplies image data to the recording apparatus;

wherein the recording material is attached to the movement section such that a standard direction specified for the recording material includes a predetermined angle with respect to the main scanning direction;

in a case in which a direction of image recording of the recording apparatus on the recording material at a time of simultaneous movement of the movement section and the recording apparatus is displaced front die standard direction, the image processing section supplies the image data to the recording apparatus having altered a predetermined recording sequence of a plurality of pixel data which form the image data to be supplied to the recording apparatus, so as to reduce shifting of image recording positions on the recording material, which shifting in caused by a difference between the image recording direction and the standard direction;

wherein the image processing section comprises:

an image data storage suction which stores image data;

an address conversion section which, so as to reduce the shifting of image recording positions on the recording material due to the difference between the image recording direction and the standard direction, converts addresses of writing to the image data storage section on the basis of the difference; and a writing section which writes the image data to the image data storage section on the basis of the writing addresses that have been converted by the address conversion section, wherein the address conversion section finds a pixel shift amount in the sub-scanning direction for one cycle of main scanning according to:

$$\text{sub-scanning direction pixel shift amount} = (\tan \theta 2 - \tan \theta 1) \times \text{size in main scanning direction/sub-scanning pitch}$$

$\theta 1$ being the image recording direction relative to the main scanning direction and $\theta 2$ being the standard direction relative to the main scanning direction, and finds a predetermined number of pixels in the main scanning direction until a one-pixel shift in the sub-scanning direction according to:

$$\text{main scanning direction predetermined pixel number} = \text{total number of pixels in the main scanning direction/the sub-scanning direction pixel shift amount.}$$

19. The image-recording device of claim 18, wherein the angles $\theta$ of the image recording direction relative to the main scanning direction and of the standard direction relative to the main scanning direction are each found according to:

$$\tan\theta = (\text{number of channels}) \times (\text{sub-scanning pitch}) / (\text{main scanning direction size})$$

the number of channels being a number of light sources, and the sub-scanning pitch being determined by a resolution.

20. An image-recording method with an image-recording device which includes a movement section which moves a recording material in a main scanning direction and a recording apparatus which, while moving in a sub-scanning direction which intersects the main scanning direction, records an image at the recording material on the basis of supplied image data, the image-recording method comprising:

disposing at least one of the recording material and the recording apparatus such that a standard direction, which is specified for the recording material, and the main scanning direction are at a predetermined angle; and in a case in which a direction of image recording of the recording apparatus on the recording material is displaced from the standard direction at a time of simultaneous movement of the movement section and the recording apparatus, supplying the image data to the recording apparatus having altered a predetermined recording sequence of a plurality of pixel data which form the image data to be supplied to the recording apparatus, so as to reduce shifting of image recording positions on the recording material, which shifting is caused by the difference between the image recording direction and the standard direction.

* * * * *